US007950379B2

(12) United States Patent
Tidman

(10) Patent No.: US 7,950,379 B2
(45) Date of Patent: May 31, 2011

(54) HIGH VELOCITY MASS ACCELERATOR AND METHOD OF USE THEREOF

(75) Inventor: Derek A. Tidman, McLean, VA (US)

(73) Assignee: Advanced Launch Corporation, McLean, VA (US)

( * ) Notice: Subject to any disclaimer, the term of this patent is extended or adjusted under 35 U.S.C. 154(b) by 133 days.

(21) Appl. No.: 12/174,354

(22) Filed: Jul. 16, 2008

(65) Prior Publication Data

US 2009/0301454 A1 Dec. 10, 2009

Related U.S. Application Data

(60) Provisional application No. 60/935,138, filed on Jul. 27, 2007.

(51) Int. Cl.
*F41B 3/04* (2006.01)

(52) U.S. Cl. ..... 124/6; 124/1; 124/3; 124/4; 124/8; 124/56; 124/60; 124/73; 74/86; 74/87; 89/8

(58) Field of Classification Search ..... 124/1, 6, 124/8, 56, 60, 73, 3–4; 74/86–87; 89/8
See application file for complete search history.

(56) References Cited

U.S. PATENT DOCUMENTS 1,201,626 A * 10/1916 Reynolds ..... 124/6
2,644,270 A * 7/1953 Marong ..... 446/170
2,684,062 A * 7/1954 Rose ..... 124/6
3,185,479 A * 5/1965 Ortega ..... 473/509
4,135,372 A * 1/1979 Benson ..... 464/11
4,238,968 A * 12/1980 Cook ..... 74/84 R
4,378,740 A * 4/1983 Schneider, Jr. ..... 102/216
4,463,745 A * 8/1984 Acker ..... 124/6
4,942,775 A * 7/1990 Monkewitz et al. ..... 73/865.3
5,388,470 A * 2/1995 Marsh, Jr. ..... 74/84 R
5,699,779 A * 12/1997 Tidman ..... 124/6
5,819,715 A * 10/1998 Haneda et al. ..... 124/6
5,950,608 A * 9/1999 Tidman ..... 124/6
6,014,964 A * 1/2000 Tidman ..... 124/6
6,696,775 B2 * 2/2004 Engel ..... 310/135
6,712,055 B1 * 3/2004 Tidman ..... 124/6
7,013,988 B2 * 3/2006 Westmeyer et al. ..... 175/19
7,032,584 B2 * 4/2006 Tidman et al. ..... 124/6
7,500,477 B2 * 3/2009 Westmeyer et al. ..... 124/6
2004/0221838 A1 * 11/2004 Tidman et al. ..... 124/6
2005/0172943 A1 * 8/2005 Cucjen et al. ..... 124/6
2005/0249576 A1 * 11/2005 Westmeyer et al. ..... 414/1
2009/0314270 A1 * 12/2009 Westmeyer et al. ..... 124/6

OTHER PUBLICATIONS

"Sling Launch of a Mass Using Super-conducting Levitation", (submitted Oct. 30, 1994) D. A. Tidman, IEEE Trans. Magnetics, vol. 32, No. 1, pp. 240-247, Jan. 1996.

(Continued)

*Primary Examiner* — Gene Kim
*Assistant Examiner* — Alexander R Niconovich
(74) *Attorney, Agent, or Firm* — Arent Fox, LLP

(57) ABSTRACT

An apparatus for moving a mass, the apparatus having an arcuate track, a clamping member attached to a section of the arcuate track, an arm assembly pivotably connected to the clamping member, and a counterweight connected to the arm assembly. A projectile for use in a mass accelerator having an arcuate track, the projectile having a core and at least one of a low-friction layer, a propellant layer, and a polycarbonate layer.

24 Claims, 24 Drawing Sheets

OTHER PUBLICATIONS

"Sling Launch of Materials into Space", D. A. Tidman, R. L. Burton, D. S. Jenkins, and F. D. Witherspoon, in Proceedings of the 12th SSI/Princeton Conference on Space Manufacturing, May 4-7, 1995, edited by B. Faughnan, pp. 1-12.

The "Slingatron", by John Kross, AD ASTRA (Magazine of the National Space Society) Sep./Oct. 1996, pp. 47-51.

"Slingatron Mass Launchers", D. A. Tidman, Journal of Propulsion and Power, vol. 14, No. 4, pp. 537-544, Jul.-Aug. 1998.

"Slingatron Dynamics and Launch to LEO", D. A. Tidman, Proceedings of the 13th SSI/Princeton Conference on Space Manufacturing, (Space Manufacturing 11), May 8-11, 1997, edited by B. Faughnan, Space Studies Institute, Princeton, NJ, pp. 139-141.

"Slingatron Engineering and Early Experiments", D. A. Tidman and J. R. Greig, Proceedings of the 14th SSI/Princeton Conference on Space Manufacturing, May 6-9, 1999, pp. 306-312, edited by B. Faughnan, Space Studies Institute, Princeton, NJ. (Spiral).

D. A. Tidman, "A Scientific Study on Sliding Friction Related to Slingatrons", UTRON Inc., Final Report for U.S. Army Contract No. DAAD17-00-P-0710, Feb. 20, 2001.

M. Bundy, G. R. Cooper, S. Wilkerson, "Optimizing a Slingatron-Based Space Launcher Using Matlab," Proceedings of the 10th U.S. Army Gun Dynamics Symposium, Apr. 23-26, 2001, Austin, Texas (p. 474).

G. R. Cooper, D. A. Tidman, M. Bundy, and S. Wilkerson, "Numerical Simulations of the Slingatron," Proceedings of the 10th U.S. Army Gun Dynamics Symposium, Apr. 23-26, 2001, Austin, Texas (p. 491).

D. A. Tidman, "Slingatron: A High Velocity Rapid Fire Sling," Journal of Propulsion and Power, A publication of the American Institute of Aeronautics and astronautics, Inc., vol. 18, No. 2, pp. 322-329.

D. A. Tidman, "The Spiral Slingatron Mass Launcher," CP552, Space Technology and Applications International Forum-2001, edited by M. S. El-Genk, published by the American Institute of Physics, 2001.

G. R. Cooper, D. A. Tidman, and M. L. Bundy, "Numerical Simulations of the Slingatron,"AIAA Journal of Propulsion and Power, vol. 18, No. 2, Mar.-Apr. 2002, pp. 338-343.

M. L. Bundy, D. A. Tidman and G. R. Cooper, "Sizing a Slingatron-Based Space Launcher," AIAA Journal of Propulsion and Power, vol. 18, No. 2, Mar.-Apr. 2002, pp. 330-337.

D. A. Tidman, "Slingatron: A High Velocity Rapid Fire Sling," 10th U.S. Army Gun Dynamics Symposium, Advanced Launch Corporation, Apr. 23-26, 2001, pp. 509-526.

G. R. Cooper and D. A. Tidman, "Study of the Phase-Lock Phenomenon for a Circular Slingatron," AIAA Journal of Propulsion and Power, vol. 18, No. 3, May-Jun. 2002, pp. 505-508.

"Constant-Frequency Hypervelocity Slings", D. A. Tidman, AIAA Journal of Propulsion and Power, Jul.-Aug., vol. 19, No. 4, 2003, pp. 581-587.

"Slingatron—A Mechanical Hypervelocity Mass Accelerator" D. A. Tidman, published by Aardvark Global Publishing LLC, 2007. (Available on Amazon Books, search word slingatron).

www.slingatron.com and www.slingatron.net.

* cited by examiner

HIGH VELOCITY MASS ACCELERATOR AND METHOD OF USE THEREOF

This application is based upon and claims the benefit of priority from the prior U.S. Provisional Application No. 60/935,138 filed on Jul. 27, 2007, titled A MECHANICAL HYPERVELOCITY MASS ACCELERATOR, the entire contents of which are incorporated herein by reference.

Additional details of the dynamics of these machines can be found in a book entitled "Slingatron—A Mechanical Hypervelocity Mass Accelerator", D. A. Tidman, published by Aardvark Global Publishing LLC, 2007, the contents of which are incorporated herein by reference.

BACKGROUND OF THE INVENTION

1. Field of the Invention

The present invention relates to devices, systems, and methods for accelerating a mass along a spiral or arcuate gyrating path that accelerates and launches the mass.

2. Background of the Related Art

The following patents listing the present inventor discuss mass accelerators, the entire contents of each of which are incorporated herein by reference: U.S. Pat. No. 5,699,779, that issued on Dec. 23, 1997, titled Method of and Apparatus for Moving a Mass; U.S. Pat. No. 5,950,608, that issued on Sep. 14, 1999, titled Method of and Apparatus for Moving a Mass; U.S. Pat. No. 6,014,964, that issued on Jan. 18, 2000, titled Method and Apparatus for Moving a Mass in a Spiral Track; U.S. Pat. No. 6,712,055, that issued on Mar. 30, 2004, titled Spiral Mass Launcher; U.S. Pat. No. 7,032,584, that issued on Apr. 25, 2006, titled Spiral Mass Launcher.

A mechanical mass accelerator, also referred to as a "mass accelerator" in the related art, operates in a manner that is conceptually and mechanically similar to the ancient weapon known as a sling. Unlike the weapon of antiquity, however, modern mass accelerators are capable of accelerating projectiles to velocities of many km/sec (i.e., "hypervelocities").

To accelerate a mass or projectile as it moves along a curved path or track, such a device moves the track itself along the direction of the centripetal force acting on the mass at any given moment. This is akin to the movement a Jai Alai racquet makes when the player uses it to hurl the ball at speeds in excess of 300 km/h. The moving mechanical mass accelerator track performs work on the projectile along a curved path to cause its acceleration. Repeating this process many times and doing so in phase, creates a cumulative acceleration that leads to hypervelocities. The curved path or track of the mechanical mass accelerator may be, for example, a tube, track, or other path and may be configured as a multi-turn ring, a spiral or helix. Even more complex paths can also be employed and may be advantageous for certain applications.

In order to cause the motion of the entire rigid track of a mechanical mass accelerator, the entire track can be mounted on a series of distributed mechanical swing-arms that propel the tube around a circle or other arcuate path of relatively small radius without changing the geometry or orientation of the track. The mechanical mass accelerator track gyrates but does not spin. The acceleration is similar to rolling a ball bearing around in a circular frying pan in a horizontal plane (or sliding an ice cube around in an ice-cold pan) and gyrating the pan around in a small circle, except that mechanical mass accelerator gyration speeds are orders of magnitude greater and the mechanical mass accelerator track geometry can be more complicated than the circular track created by the edge of the pan.

While earlier mass launchers were serviceable, they were often too inefficient to be useful, required complicated parts that were not easily machined or replaced, lacked efficient means for projectile storage as well as projectile release, and included aspects with a lower structural stability and exhibited a relatively high degree of frictional dissipation. In adapting mass accelerators for specific applications, there remains an unmet need for devices, systems, and methods for mass acceleration that are easy to fabricate, increase efficiency, simplify the projectile release function, decrease accelerating track wear and allow the launching of projectiles with large masses to very high velocities by practice of aspects of the present invention.

SUMMARY OF THE INVENTION

Aspects of the present invention overcome these problems, and others, by providing devices, systems, and methods for mass acceleration including an apparatus for moving a mass, the apparatus having an arcuate track, a clamping member attached to a section of the arcuate track, an arm assembly pivotably connected to the clamping member, and a counterweight connected to the arm assembly.

The track may be shaped as a ring, a spiral, or as a helix, with any number of turns. The track may be of any size, and sections of the track may be segments that connect together to form a larger track. The track can be modular for easy assembly, disassembly, storage and transport. Track segments may include a first tube and a second tube, wherein the first tube inserts into the second tube, and wherein the second tube includes a taper on the inner side of the tube.

The track may further include at least one vent for venting gases produced in acceleration of a mass. This vent may comprise an opening in the track on a side opposite the side that comes in contact with the mass. The vent may be provided proximate to the clamping member, in order to provide greater structural stability of the track.

The clamping member may add rigidity to the track by receiving two sections of the track. The arm assembly may be provided at oblique angles to each other, or parallel to each other. The counterweights may be displaced from the location of the arm assembly.

A more rugged and efficient connection between the clamping member and the arm assembly may include at least one of bearings, a low-friction film, and a shock absorbing layer.

Aspects of the present invention may further include a housing configured to receive at least a portion of the apparatus, and wherein the housing includes a pressure feature for one of reducing the pressure within the housing and filling the housing with a selected gas.

Aspects of the present invention may further include a flywheel engageable with the arm assembly. The flywheel may be engaged with the arm assembly via an engaging mechanism such as an electromagnetic clutch.

Aspects of the present invention further include a mass storage and release feature, which may be provided as an inner turn of the arcuate track. The projectile storage and release device may be attached to a first end of the arcuate track and may move in connection with the arcuate track, while being configured to hold a plurality of masses to be inserted into the track. The projectile storage and release device may further include single or multiple stoppers such as one-way valves that prevents a mass from entering the track until it is desired to accelerate the mass.

Aspects of the present invention include a projectile for use in a mass accelerator having an arcuate track, the projectile having a core and at least one of a low-friction layer, a propellant layer, and a low thermal conductivity layer such as a polycarbonate layer. These aspects may be incorporated into a sled, the sled configured to receive a projectile for acceleration.

Aspects of the present invention may also include a projectile holding and insertion device for holding and inserting a projectile into a mass accelerator having an arcuate track, the device including a housing configured to receive a projectile, the housing connected to a track of a mass accelerator, a retention piece configured to bias against a projectile in the housing, a powder charge configured to insert at least partially into a projectile, a receiver configured to receive a remote signal, and a trigger circuit configured to trigger the powder charge upon receipt of the remote signal.

Additional advantages and novel features of aspects of the present invention will be set forth in part in the description that follows, and in part will become more apparent to those skilled in the art upon examination of the following or upon learning by practice thereof.

DETAILED DESCRIPTION OF THE INVENTION

Aspects of the present invention will now be described in connection with FIGS. 1-23. These figures are meant to show variations of components that may be incorporated in many different designs of a mechanical mass accelerator as well as other devices incorporating a mechanical mass accelerator. Although the geometry of the arcuate path is illustrated in the Figures as a simple example approximating a few turns, such as ring turns, spiral turns, and helical turns, it is evident that more complicated geometries, e.g. involving a larger number of ring or spiral turns, could be assembled from the same basic components. It is to be understood that FIGS. 1-23 are not meant to be an exhaustive record of the designs and configurations for mechanical mass accelerators. Rather, these figures show some of the basic components and illustrate some of the basic concepts that may be used to construct any number of mechanical mass accelerator-based devices. The term "basic components" is not exhaustive and is meant to encompass various illustrated swing arms, electric or combustion engines to power the gyration, track designs such as a steel mechanical mass accelerator track, track clamps, bearings, counterweights, drive motors, projectile feed, control system, support structure, and other components that may not be shown herein. Various materials can be used for the basic components shown in FIGS. 1 to 23. For example, the arcuate track may comprise a metal such as steel, steel alloys or other metals or other metal alloys. Alternatively, the arcuate track may comprise other materials such as ceramics, ceramic composites, amorphous materials, wear-resistant coatings, fibers and polymeric materials. The swing arms, to take yet another example, may comprise metals, metal alloys, composite materials such as C-fiber composites, ceramics, amorphous materials, various coatings and polymeric materials. The counterweights may comprise one of or a combination of high density materials such as various metal alloys, tungsten alloys, steel or steel alloys. The counterweights may also comprise various non-metallic materials such as ceramics, composites or polymers.

Figure 1A:
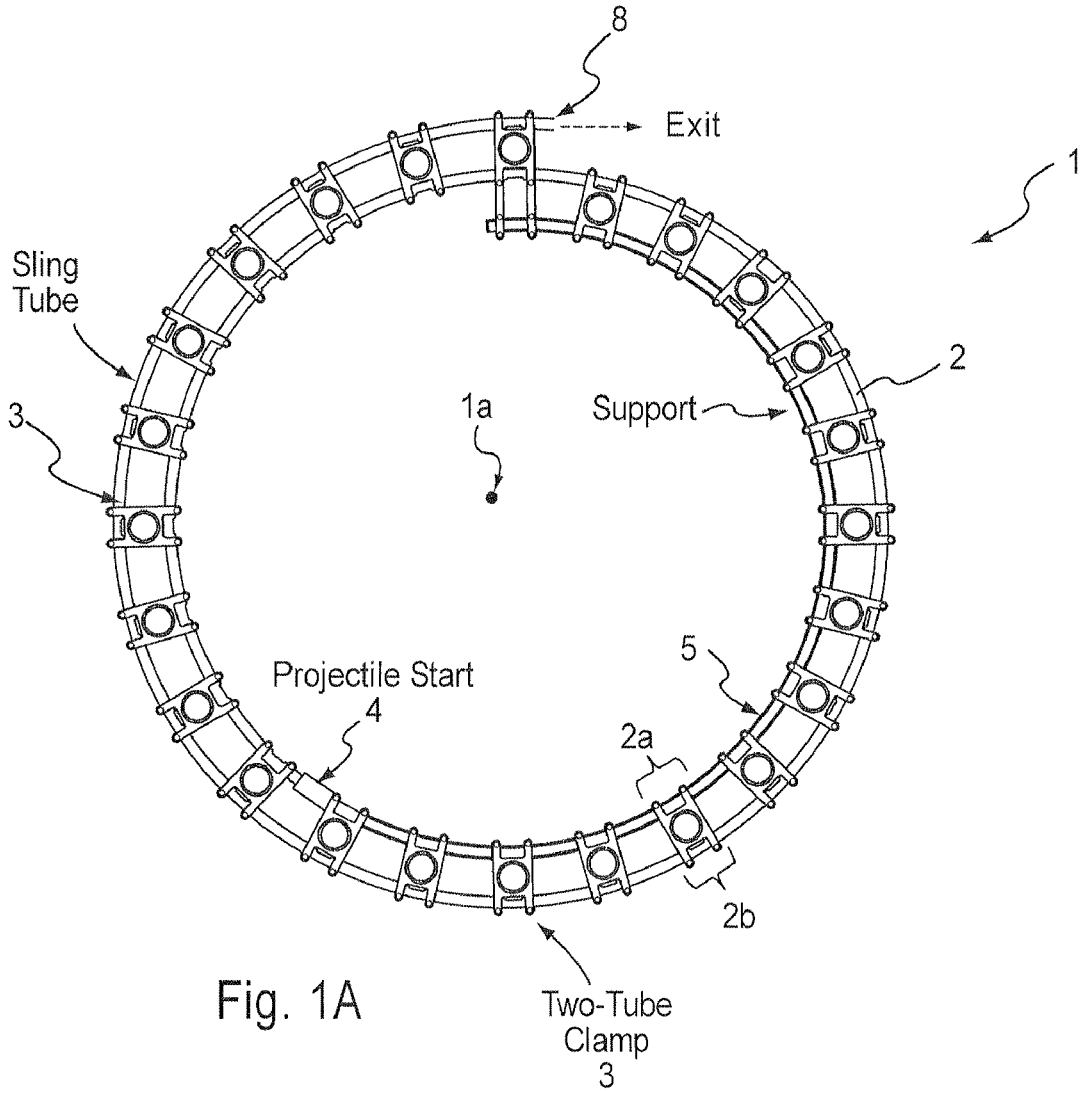
FIG. 1A is a top view of an exemplary variation of a track assembly of a mass accelerator in accordance with aspects of the present invention.

FIG. 1A is a top view of an exemplary variation of a track assembly 1 of a mass accelerator in accordance with aspects of the present invention, including an arcuate track 2 having a tight 2-turn spiral geometry that approximates a 2-turn ring. The track 2 may comprise a closed tube into which a projectile is inserted and accelerated due to the gyration of the entire track assembly 1 about the center of the track assembly 1*a*. The track 2 may also have a number of other shapes, including partially open tubes with c-shaped or rectangularly shaped cross sections. Alternatively, the track can have a flat or other shape, for example. Although FIG. 1A shows a track assembly 1 having an arcuate track 2 with two turns, as noted above, more complicated track geometries are possible and even advantageous under certain circumstances and can be assembled from the same basic components in FIG. 1A. These more complex track geometries include spiral track geometries involving a number of spiral turns in excess of two, as well as differently shaped spirals, elliptical spirals or nested track assemblies including multiple arcuate tracks (not shown). Also, elliptical, linear or other shaped tracks can be incorporated into mechanical mass accelerator based devices.

Figure 1B:
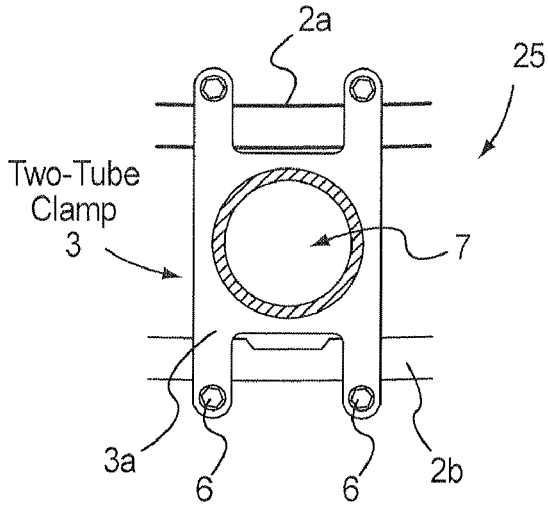
FIG. 1B is an inset, close-up top view of a section of the track assembly of FIG. 1A including a clamping member as well as two sections of the track.

FIG. 1A shows 24 pairs of clamping members 3, each with a front side 3*a* and a backside 3*b* (not shown), clamped around the track 2 using bolts 6 or other fastening members. The clamping members 3 serve to hold the track together so that the overall shape of the track assembly 1 is rigidly maintained even when the track is subject to extreme lateral forces. FIG. 1A shows the clamping members 3 distributed evenly around the circumference of the track assembly 1. Alternatively, the clamping members 3 can be distributed in a manner that is uneven in order to provide greater structural support to certain sections of the track assembly 1. FIG. 1B is an inset, close-up top view of a section 25 of the track assembly 1 of FIG. 1A including a clamping member 3 as well as two sections 2*a* and 2*b* of the track 2. As shown in FIGS. 1A and 1B, the clamping members 3 may connect two or more sections 2*a*, 2*b* of track 2, in order to increase the overall structural stability and rigidity of the track assembly 1. As also shown in FIG. 1B, each clamping member 3 may include a central portion 7 provided to pivotably attach the clamping members 3 and, therefore, the track assembly 1 to other mechanical devices that cause the entire track assembly 1 to gyrate. It is this gyration, as will be shown below, that gives rise to mass accelerations to hypervelocities. FIG. 1A also shows the exit point 8 of the track assembly 1 from which the projectile is launched.

FIGS. 1A and 1B also show an inner section 5 of the track assembly 1 shown in black. The inner section 5 is not necessarily used to accelerate projectiles and, therefore, may often be used for other purposes such as the storage or transport of projectiles (not shown). Projectiles stored in the inner section 5 can be fed forward by the gyration motion of the track assembly 1 itself as the track 2 accelerates a projectile, as is described in more detail in connection with FIG. 11. Alternatively, the track assembly 1 and/or the inner section 5 can be provided with another form of active or inactive projectile advancing and launching mechanism.

As shown in FIG. 1A, the inner section 5 can include a projectile start section 4 where it connects with the track 2. The projectile start section 4 prepares the projectile for releasing into the accelerating portion of the track assembly 1. A stopper mechanism (not shown) may be provided inside or adjacent to the projectile start section 4 to control the introduction of projectiles into the track 2. In particular, the stopper mechanism (not shown) can allow only a predetermined number of projectiles to proceed into the track 2 for acceleration at any given time. The stopper mechanism (not shown) may include a one-way, feed forward valve that prevents projectiles in the inner section 5 from sliding away from the projectile start section 4 and the track 2 during the gyration of the track assembly 1.

Timing of the release of projectiles from the projectile start section 4 can be important in some applications. In particular, it is sometimes advantageous to time the release of the projectiles from the projectile start section 4 into the accelerating track 2 so that they are released with a phase relationship that maximizes their acceleration through the remaining 1.4 turns of the 2-turn ring of the track 2. It may be preferable for the projectile start section 4 to release projectiles into the track 2 one at a time according either to a preset timing regime or a trigger mechanism. Using the inner section 5 as a projectile storage section mounted directly to the track assembly 1 is a relatively simple and robust means of allowing the release of the mass or projectile into the acceleration portion of the track 2 with the correct phase to maximize acceleration.

Figure 2:
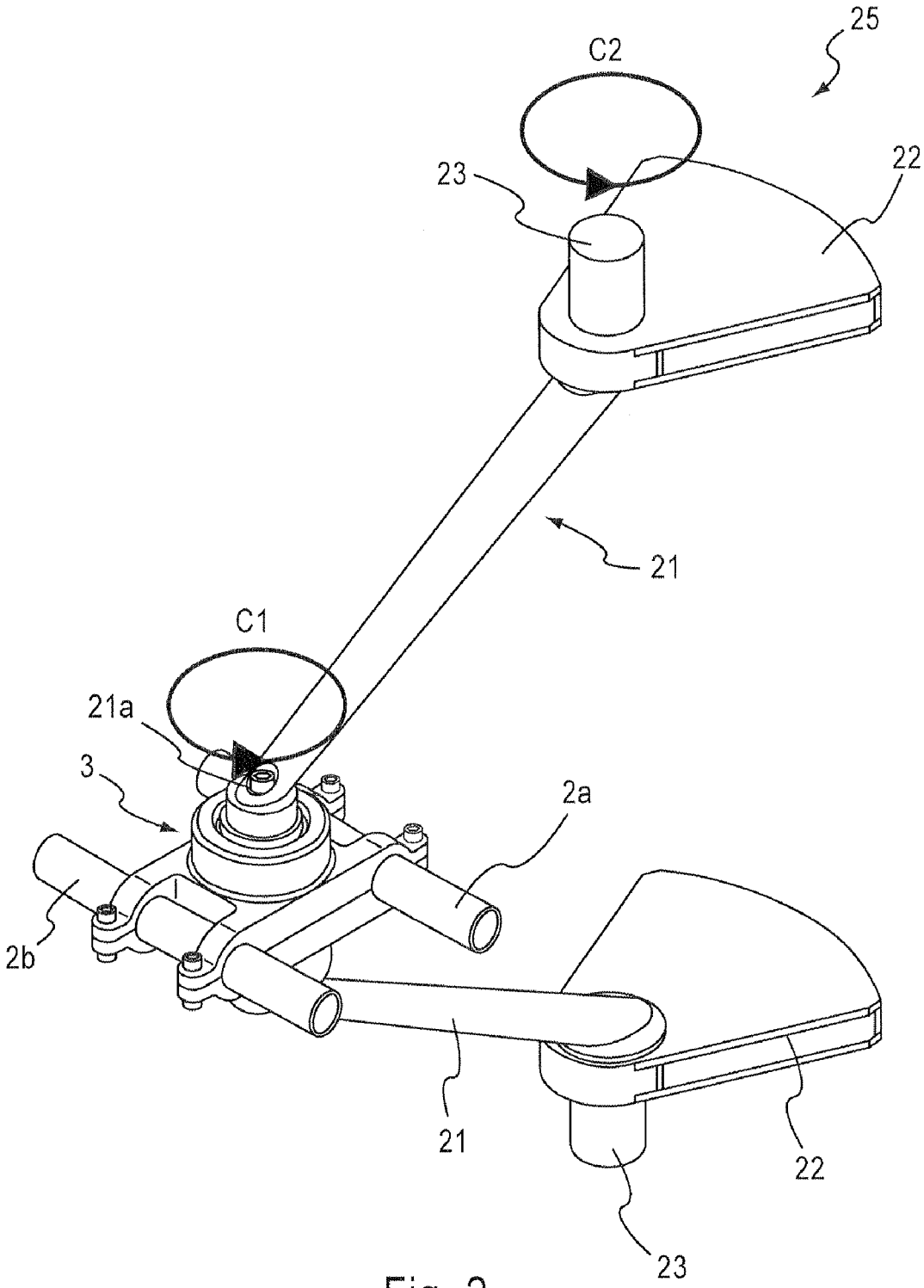
FIG. 2 is a close-up, perspective view of the track assembly section shown in FIG. 1B along with mounted swing arms for causing gyration of the track section.

FIG. 2 is a close-up, perspective view of the track assembly section 25 shown in FIG. 1B along with mounted swing arms 21 for causing gyration of the track section 25. As shown in FIG. 2, the clamping member 3 clamps two sections of a mass accelerator track 2*a* and 2*b* to each other and to the pair of swing arms 21. The pair of swing arms 21 is pivotably attached to the clamping member 3 via the opening 7 in the clamping member and is able to pivot about the pivot point 21*a*. The pivot point 21*a* is such that the swing arms 21 can pivot a full 360° along direction C1 about the pivot point 21*a*. The pivot point is also such that the swing arms 21 can pivot a full 360° along the opposite direction of C1. The swing arms 21 are also connected to the center shafts 23 and are able to pivot a full 360° along direction C2 about the center shafts 23. The swing shafts are also able to pivot a full 360° along the direction opposite C2.

As shown in FIG. 2, another end of each swing arms 21 is connected to a counterweight 22. The counterweights 22 can balance or partially balance the mass of the swing-arm pair so that there is essentially zero or reduced transverse force acting on the center shafts 23 as they rotate about the direction C2 (or its reverse). The pivot point 21*a* on the other end of the swing arms 21 allows, on the other hand, the two parallel track segments 2*a* and 2*b* at the end of the swing-arms 21 to maintain their orientation with respect to one another (e.g., the orientation shown in FIGS. 1A and 2 in which track segment 2*a* is closer to the center of the track assembly 1*a* than is track segment 2*b*) even as pivoting the swing arms 21 360° along direction C2 about the center shafts 23 causes the entire track section 1 to gyrate about the center of the track assembly 1*a* (FIG. 1A). As also shown in FIG. 2, the thickness of the swing arms 21 may be tapered from the counterweights 22 to the pivot point 21*a* in order to allow the swing arms 21 to take on additional load at the thicker end. Alternatively, the thickness of the swing arms 21 may be tapered in the opposite sense as that shown in FIG. 1 or may be untapered. It should be noted that the track assembly section 25 with swing arm pairs 21 shown in FIG. 2 can be used to form many more track assembly geometries than the simple 2-turn track assembly 1 shown in FIG. 1A. In fact, the track assembly section 25 with swing arm pairs 21 shown in FIG. 2 can be used to form track assemblies with any number of rings.

Figure 3:
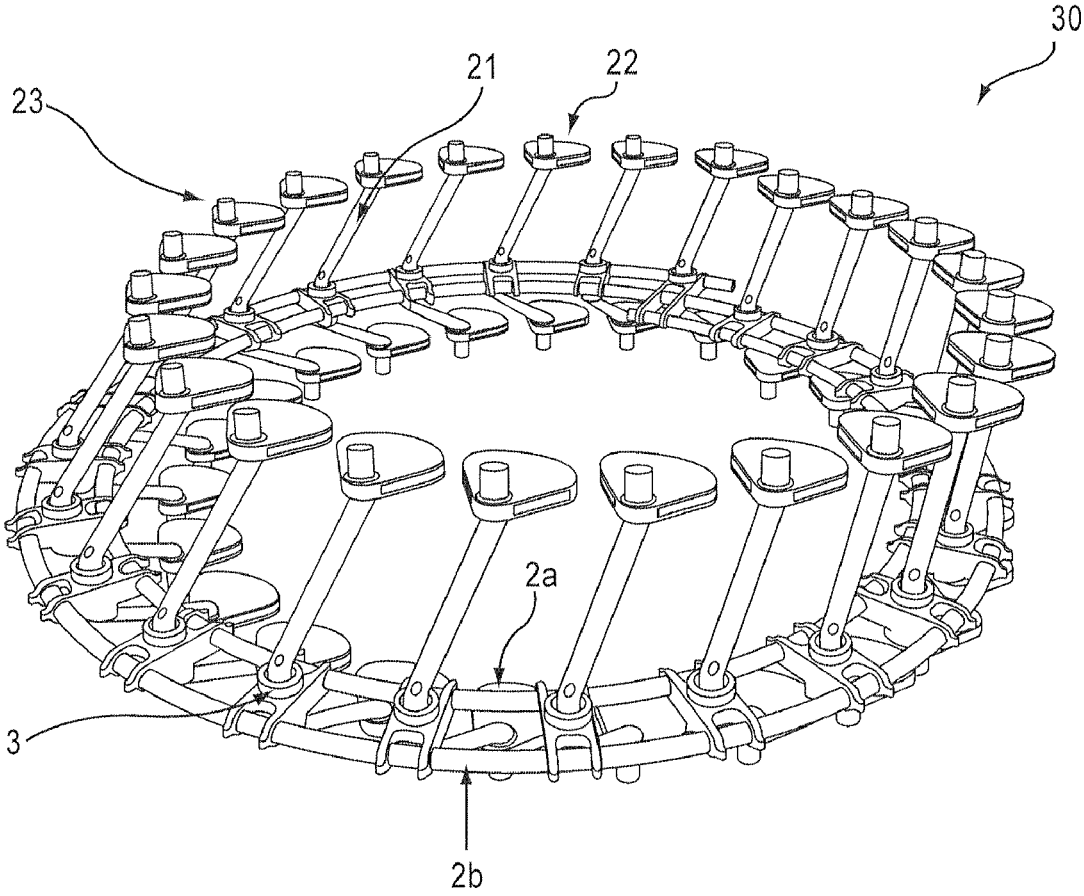
FIG. 3 is a perspective view of an assembly that includes the track assembly of FIG. 1 as well as swing arms for causing gyration of the assembly.

FIG. 3 is a perspective view of an assembly 30 that includes the track assembly 1 of FIG. 1 as well as swing arms 21 for causing gyration of the assembly. As shown in FIG. 3, each of the clamping members 3 has an associated swing arm pair 21 pivotably mounted to it as shown in FIG. 2. As is also shown in FIG. 3, each of the swing arm pairs 21 in the assembly 30 is oriented so as to be parallel with each of the other swing arm pairs 21 so that they can pivot in tandem about the center shafts 23. The swing arms 21 maintain this parallel orientation as they cause the entire track assembly 1 to gyrate. In order to cause the acceleration of a projectile, the projectile (not shown) is released from the projectile start point 4 at a specified phase in the gyration of the track assembly 1 caused by the pivoting of the swing arms 21. The details of the dynamics for this are described in the "Slingatron—A Mechanical Hypervelocity Mass Accelerator" and in other publications incorporated by reference above. It is to be understood that FIG. 3 is a representation of some of the essential components of a mechanical mass accelerator. The mechanical mass accelerator may further include other components such as various mechanical supports or a support frame that are not shown in this figure.

Figure 4:
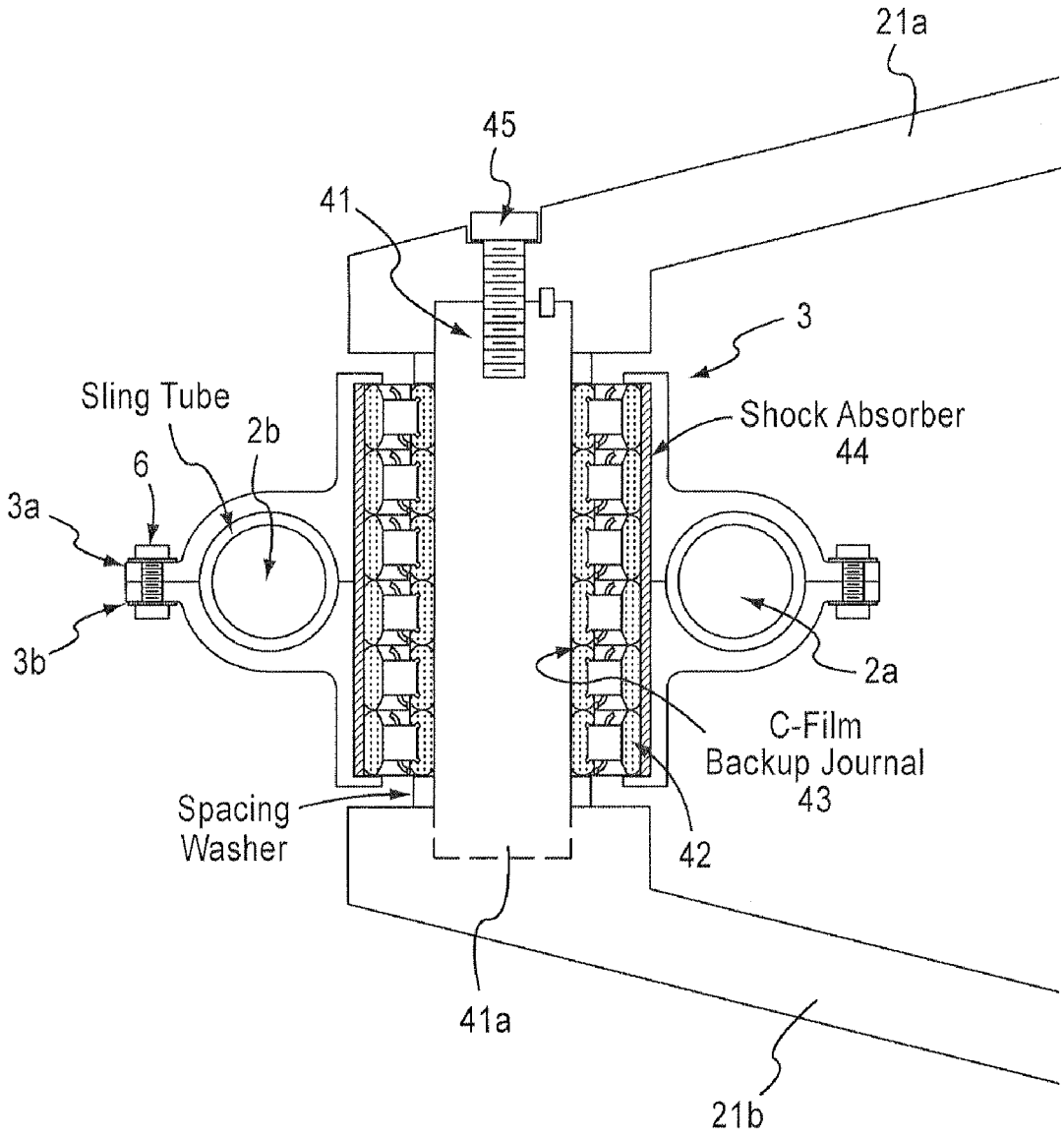
FIG. 4 is a cross section of an exemplary clamping member and swing arm pair that may be used in connection with aspects of the present invention.

FIG. 4 is a cross section of an exemplary clamping member 3 and swing arm pair 21 that may be used in connection with aspects of the present invention. As shown in FIG. 4, the clamping member 3 comprises a first plate 3*a* fixed to a second plate 3*b* via an attachment member, such as a bolt 6 or other attachment member. The first plate 3*a* and second plate 3*b* clamp in place portions 2*a* and 2*b* of the track. The opening 7 of the clamping member 3 receives a shaft 41 attached to at least one swing arm 21. The clamping member 3 is capable of pivoting about the shaft 41 as the track assembly 1 gyrates.

FIG. 4 also shows a number of friction reducing features that may be incorporated between the clamping member 3 and the shaft 41 to increase the efficiency and failure resistance of the mass accelerator. For example, an interior stack of roller bearings 42 may separate the clamping member 3 from the shaft 41. In FIG. 4, a stack of six bearings is shown. However, any suitable number of bearings may be used. The bearings 42 are held in place by the first plate 3*a* and second plate 3*b* of the clamping member 3 that also clamp the track 2 shown in FIGS. 1 to 3. The bearings 42 allow the track to pivot with respect to the pair of swing arms 21*a* and 21*b* shown in FIG. 4. In assembly, the lower end 41*a* of the shaft 41 may be welded to the lower swing arm 21*b*. This allows the bearings 42 and clamping member 3 to be stacked on the shaft 41 and, subsequently, for the upper swing arm 21*a* to be bolted to the shaft.

FIG. 4 also illustrates a cylindrical layer 44 located between the clamping member 3 and the bearings 42. This cylindrical layer may include a shock absorbing material, such as an elastomer. A shock absorber placed in the cylindrical layer 44 alleviates the impulsive load created by a projectile passing through the portions 2*a* or 2*b* of the track 2 in the vicinity of the clamping member 3. FIG. 4 also shows a layer 43 between the bearings 42 and the shaft 41 that may also include a friction reducing material such as a carbon film. In fact, layers of friction reducing material may be provided on the surfaces of the shaft 41 and bearings 42. Using friction reducing material in connection with bearings 42, enables the entire clamping member 3 to pivot around the shaft 41 even in the case of the failure of one or more of the bearings 42. It is to be understood that each of the friction reducing features shown here may be used individually, in combination or in combination with other suitable friction reducing features.

Figure 5:
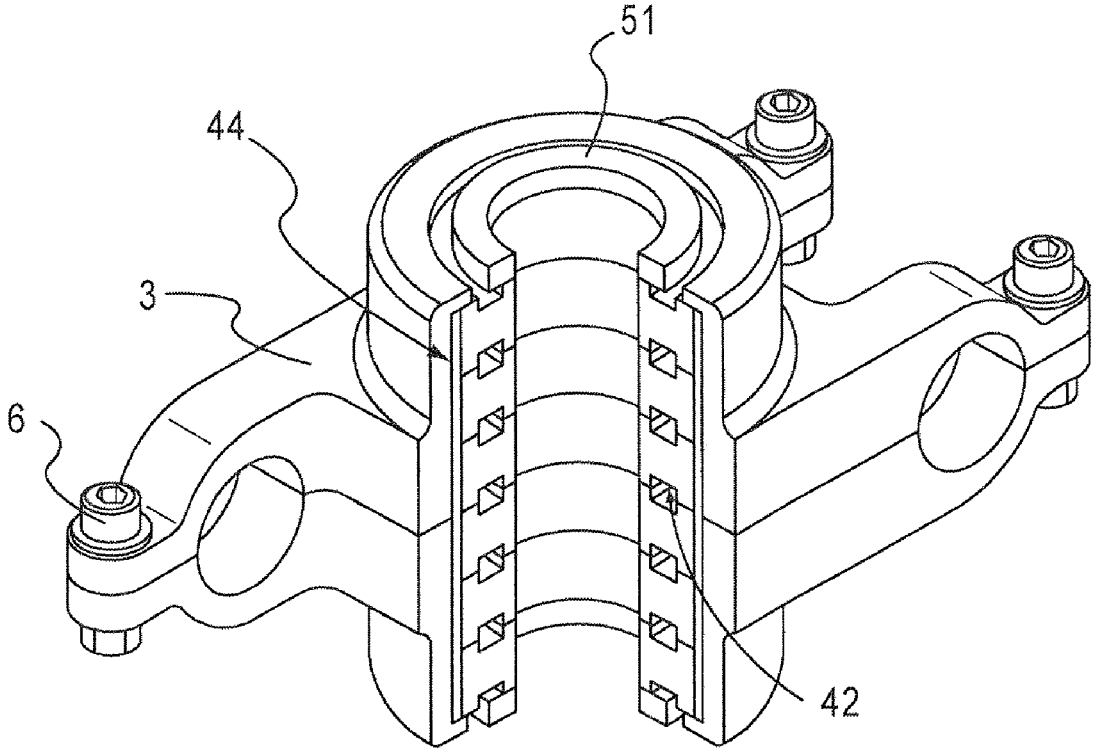
FIG. 5 is a cutaway view of an exemplary single clamping member.

FIG. 5 is a cutaway view of an exemplary single clamping member 3. FIG. 5 shows a spacer 51 made of a material such as steel, steel alloy, other metal alloy or other suitable material. A shock absorbing layer 44 is shown located between bearings 42 and the clamping member 3. Provision of a shock absorbing layer 44 between the bearings 42 and the clamping member 3 increases the lifetimes of the bearings by evenly distributing load across the surfaces of the bearings 42. As the swing arms 21 (FIG. 2) and the clamping member 3 pivot, thus gyrating the track assembly 1 and accelerating the projectile or mass around the curved track 2, a kick or load is experienced by the track section 25 (FIG. 2) as the projectile passes through it. The shock absorbing layer 44 absorbs a portion of that load or kick. Decreasing the load on the bearings 42 increases their usable lifetime.

Figure 6:
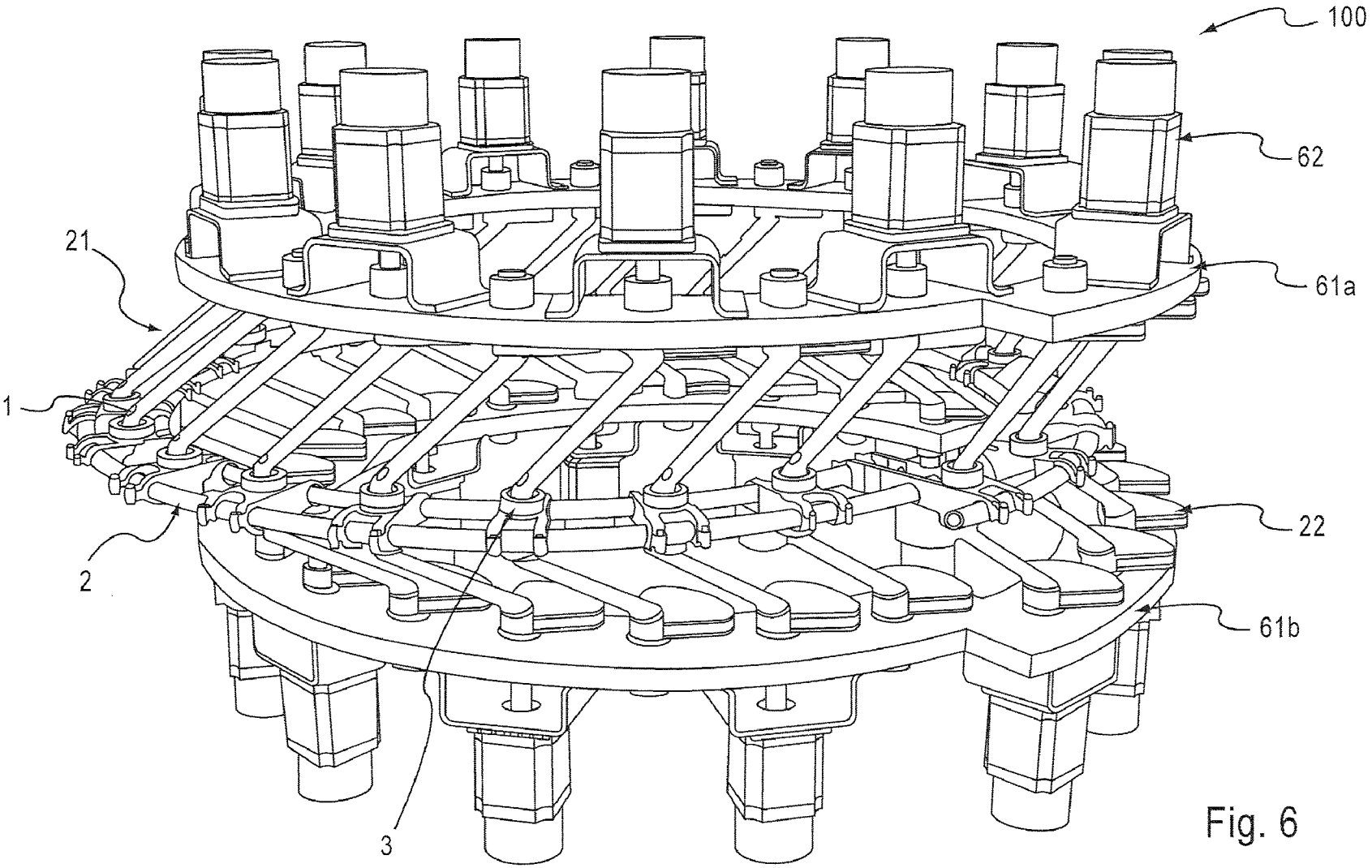
FIG. 6 shows an exemplary assembled mechanical mass accelerator formed by mounting the assembly of FIG. 3 to mounting plates containing drive motors.

FIG. 6 shows an exemplary assembled mechanical mass accelerator 100 formed by mounting the assembly 30 of FIG. 3 to mounting plates 61*a* and 61*b* as well as drive motors 62. FIG. 6 shows twelve drive motors 62, each connected to one of swing arms 21. The drive motors 62 are disposed on both the top 61*a* and bottom mounting plates 61*b*. These drive motors 62 turn the swing arms 21, thereby propelling the gyrating or orbiting motion of the track assembly 1 that, in turn, accelerates projectiles released in the system as described in "Slingatron—A Mechanical Hypervelocity Mass Accelerator" on page 27. Again, the mechanical mass accelerator 100 in FIG. 6 is a representation of some of the essential components and may further include other components such as an outer housing or various other mechanical supports and components that are not shown in this figure.

Figure 7:
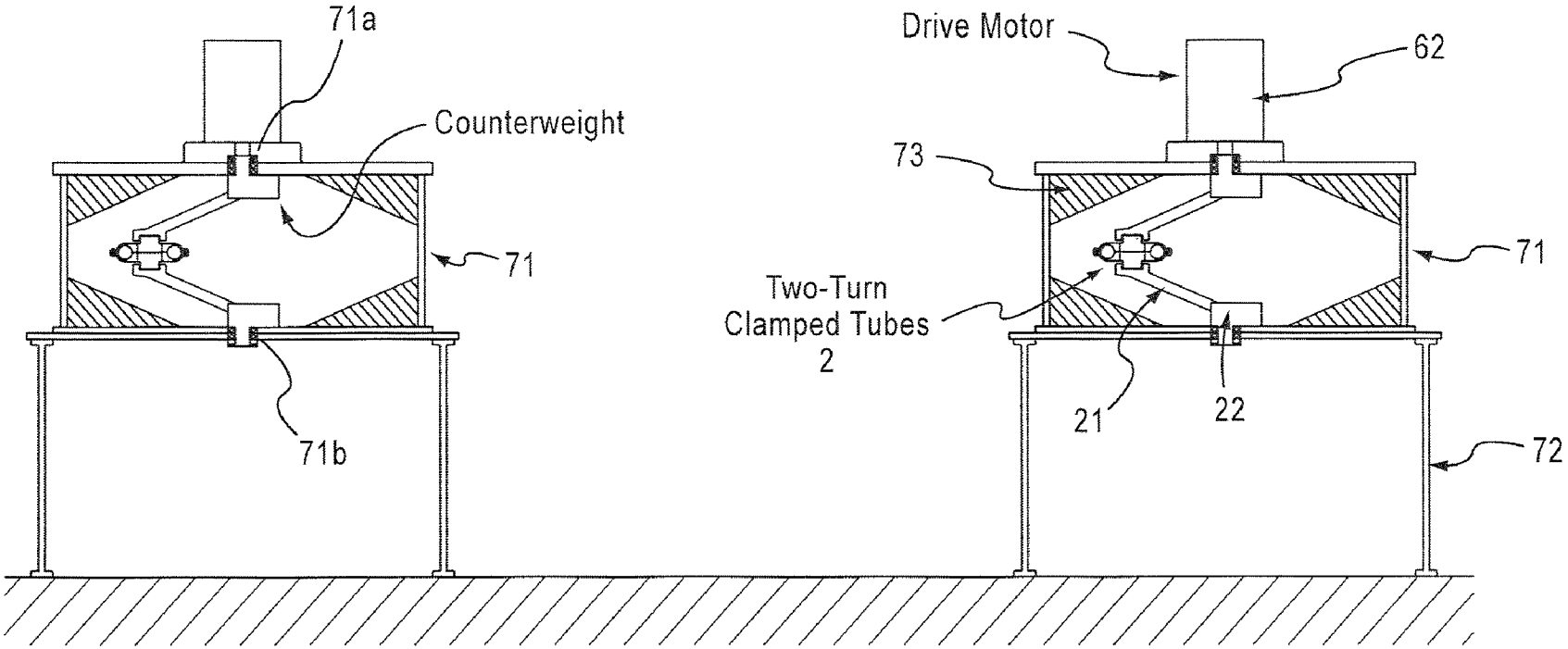
FIG. 7 illustrates an exemplary outer housing that may be used in accordance with aspects of the present invention.

FIG. 7 illustrates an exemplary outer housing 71 that may be used in accordance with aspects of the present invention. The center shafts 23 that comprise a part of the counterweights 22 may pass through the top 71*a* and bottom 71*b* sides of the outer housing 71, and the swing arms 21 may hold and gyrate the track 2 held via the clamping members 3 in the interior of the outer housing 71. This outer housing 71 may be used in connection with mechanical mass accelerator systems such as those described in FIGS. 1 to 6, or with other mechanical mass accelerator systems having other configurations and track geometries. The outer housing 71 may be circularly shaped to fit a circular track 2. Alternatively, it may have one of a number of other shapes including the shapes of a box, sphere, doughnut or lozenge.

The drive motors 62 may be provided on the exterior of the outer housing 71, as shown in FIG. 7. Alternatively, the drive motors 62 can be included within the outer housing 71 to so that the outer housing 71 provides protection for the drive motors 62. The drive motors can be located in a central position at the top of the outer housing 71, as shown in FIG. 7. Alternatively, the drive motors could be positioned around the circumference of and/or bottom mounting frame (i.e., as in FIG. 6 but with the addition of outer housing 71) of the top of the outer housing 71, or another portion of the device. Enclosing at least a portion of the machinery for the mass accelerator in the outer housing 71 or other housing (not shown) allows the operating environment of the machinery to be controlled. For example, the interior of the outer housing 71 may have a reduced air pressure or may be filled with a specific gas, such as He, chosen to reduce the amount of air drag on these components. Controlling the environment of the components in this way can be especially useful in increasing the operating efficiency of the mechanical mass accelerator when the track assembly 1 is gyrated at a high speed. The swing arms 21, counterweights 22, and track 2 may each be provided within the outer housing 71, as shown in FIG. 7. The outer housing 71 may further include structural sections 73 in portions of the interior of the outer housing 71 which are not in the path of any of the moving parts of the device. These structural sections 73 serve at least the dual purpose of increasing the structural stability of the outer housing 71 and decrease the amount of selected gas, if any, needed to fill the interior of the outer housing 71. The outer housing 71 may further include additional supports 72 between the housing and another surface.

Figure 8:
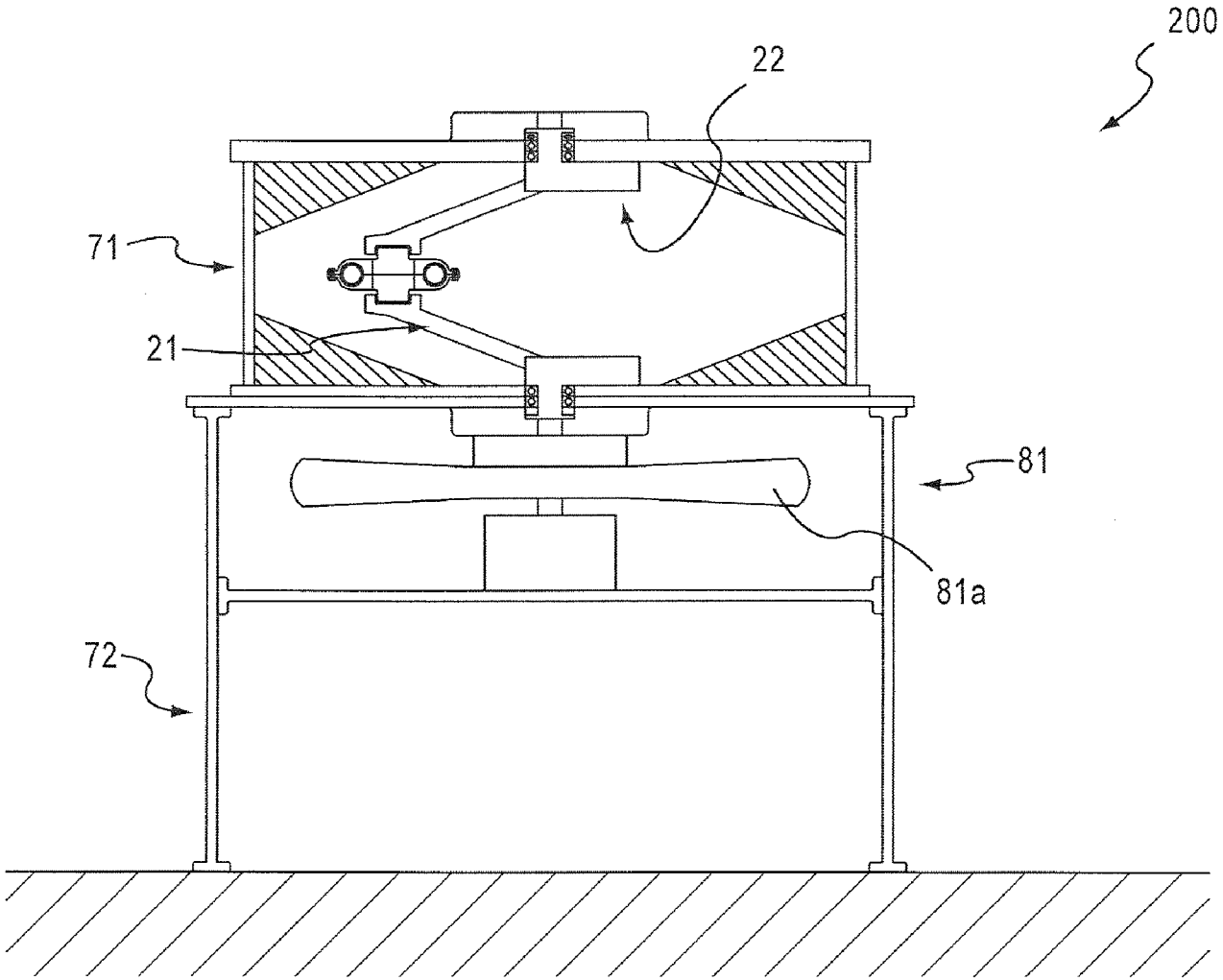
FIG. 8 shows an exemplary implementation of a mass accelerator further including a fly-wheel motor.

FIG. 8 shows an exemplary implementation of a mass accelerator 200 further including a fly-wheel motor 81. Including a fly-wheel motor 81, along with a relatively low-power electric motor to rotate it, increases the efficiency of the mass accelerator 200. Fly-wheel 81*a* types that are usable with this invention include, but are not limited to symmetric circular flywheels, as well as flywheels having other geometries and configurations. Flywheel motors 81 have the advantage that the fly wheel 81*a* can remain in its spinning state, decoupled from the swing arm 21, for a relatively long time without much frictional dissipation. The flywheel motor 81 may further include an engagement mechanism for selectively engaging the flywheel motor 81 with the swing arms 21, in order to use the flywheel 81*a* itself to rotate the swing arms 21. This engagement mechanism may include, for example, a clutch such as an electromagnetic clutch or a mechanical friction plate clutch. The engagement mechanism could facilitate rapid projectile launch by allowing the quick engagement of the mass accelerator 200 via the closing of a clutch thereby rapidly bringing the swing arms up to the angular velocities sufficient for launching. Immediately after the desired number of projectiles has been launched, the engagement mechanism could then be decoupled or disengaged from the swing arms 21 so that residual inertial energy in the flywheels can be stored for later launches of a projectile. Increasing the efficiency of the mass accelerator 200 by using a flywheel motor 81 and/or engagement mechanism also may lead to other advantages such as allowing the use of smaller motors or motors that draw less power.

As mentioned above, among other things, the engagement mechanism may include a clutch that incorporates electromagnets. For example, the rotor portion of the clutch could become magnetized so that it sets up a magnetic loop that attracts the armature (not shown). The armature is pulled against the rotor by this attraction and a frictional force is generated on contact. Within a relatively short time, the load can then be accelerated to match the speed of the rotor.

Figure 9:
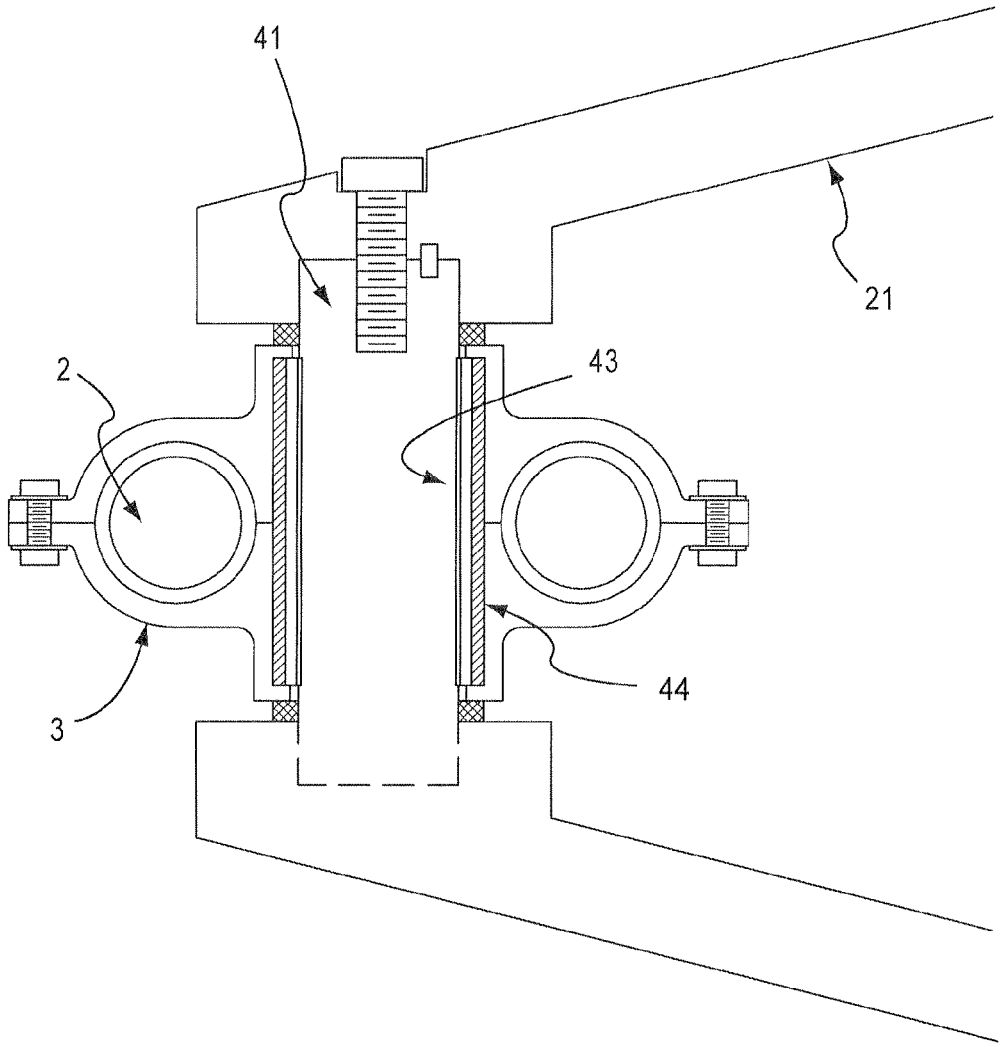
FIG. 9 illustrates an exemplary cross section of another variation of a pair of swing arms connected to a clamping member.

FIG. 9 illustrates an exemplary cross section of another variation of a pair of swing arms 21 connected to a clamping member 3. In this variation, a low-friction layer 43 such as a low-friction carbon film is provided between the shaft 41 and the clamping member 3. Unlike in FIG. 4, in the variation shown in FIG. 9 there are no roller bearings provided. Instead, a low-friction layer 43, such as carbon film journal bearings, is used. Although low-friction layers such as carbon film journal bearings have larger sliding friction coefficients than the rolling friction coefficient of roller bearings, they have much lower mass. Thus, the use of carbon film journal bearings and other low friction layers 43, as shown in FIG. 9, could significantly reduce the mass of the clamping member 3 at the end of the arm pairs 21, thereby allowing a higher gyration or swing velocity and possibly resulting in a higher projectile acceleration and launch velocity. Low Friction Carbon films have been developed and are available at Argonne National Laboratory. It is to be understood that, although FIG. 9 illustrates a low-friction layer 43 used without roller bearings 42, either roller or a low-friction layer, or a combination of both may be used in mass accelerators according to aspects of the present invention. FIG. 9 also shows the clamping member further including a shock absorbing layer 44, as described in more detail in connection with FIG. 4. The low-friction layer 43 may be used with or without the shock absorbing layer 44. Further, a flywheel motor 81 may be used in conjunction with low friction layers 43 to further increase the efficiency of the mass accelerator.

Figure 10:
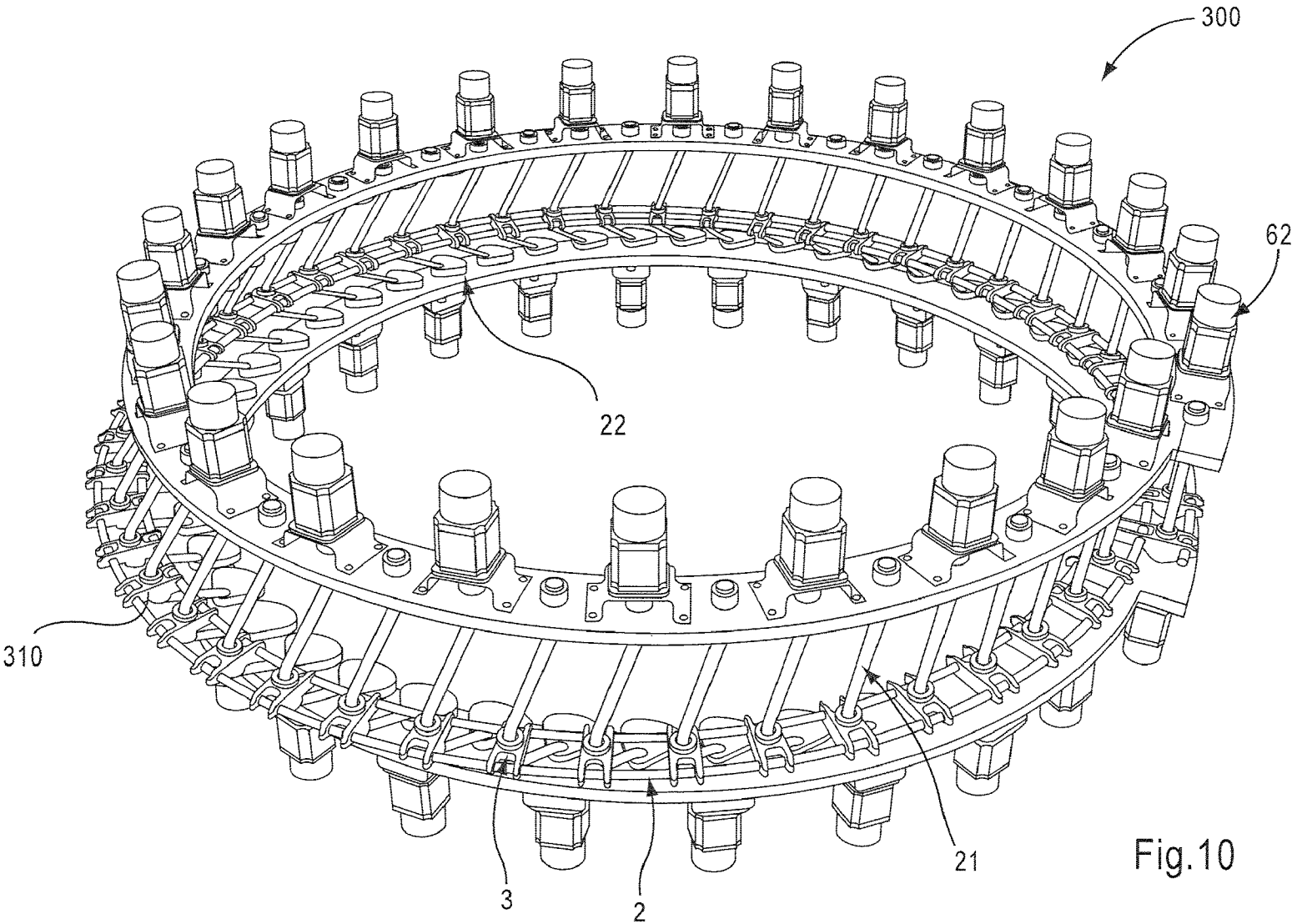
FIG. 10 illustrates a relatively large mass accelerator including a 2-turn track assembly for which the ratio R/r is larger than that for the mass accelerator in FIG. 6.

FIG. 10 illustrates a relatively large mechanical mass accelerator 300 including a 2-turn track assembly 310 for which the ratio R/r (where R is the radius of the circular track and r is the swing radius, or radius of the swinging motion of the swing arms 21) is larger than that for the mass accelerator 100 in FIG. 6. Note that one major difference between the mass accelerators 300 and 100, is that the former can use the full 2 turns of its track assembly 310 for projectile acceleration as opposed to having an inner section 5 that is not used in acceleration (FIG. 1A). Although not shown, the mechanical mass accelerator 300 may include a projectile storage and feed system that is separated from the track assembly 310. Alternatively, projectiles could be stored in additional inner rings (not shown). The swing arms can be long and tapered with their narrow ends at the clamps that are distributed along the slingatron accelerator tube. The gaps between neighboring clamps can also be kept small while at the same time avoiding interference between neighboring counterweights by using high density materials for the counterweights, and low density high strength materials including metal alloys and carbon fibers for the swing arms. For very long swing arms with very high swing speed and high projectile launch speed, the counterweights can also be designed to have less mass than would completely counterbalance the swing arm pairs. The missing orbiting mass can be provided by placing a few larger counterweights at locations displaced from the swing arms and drive motors in the system.

Figure 11A:
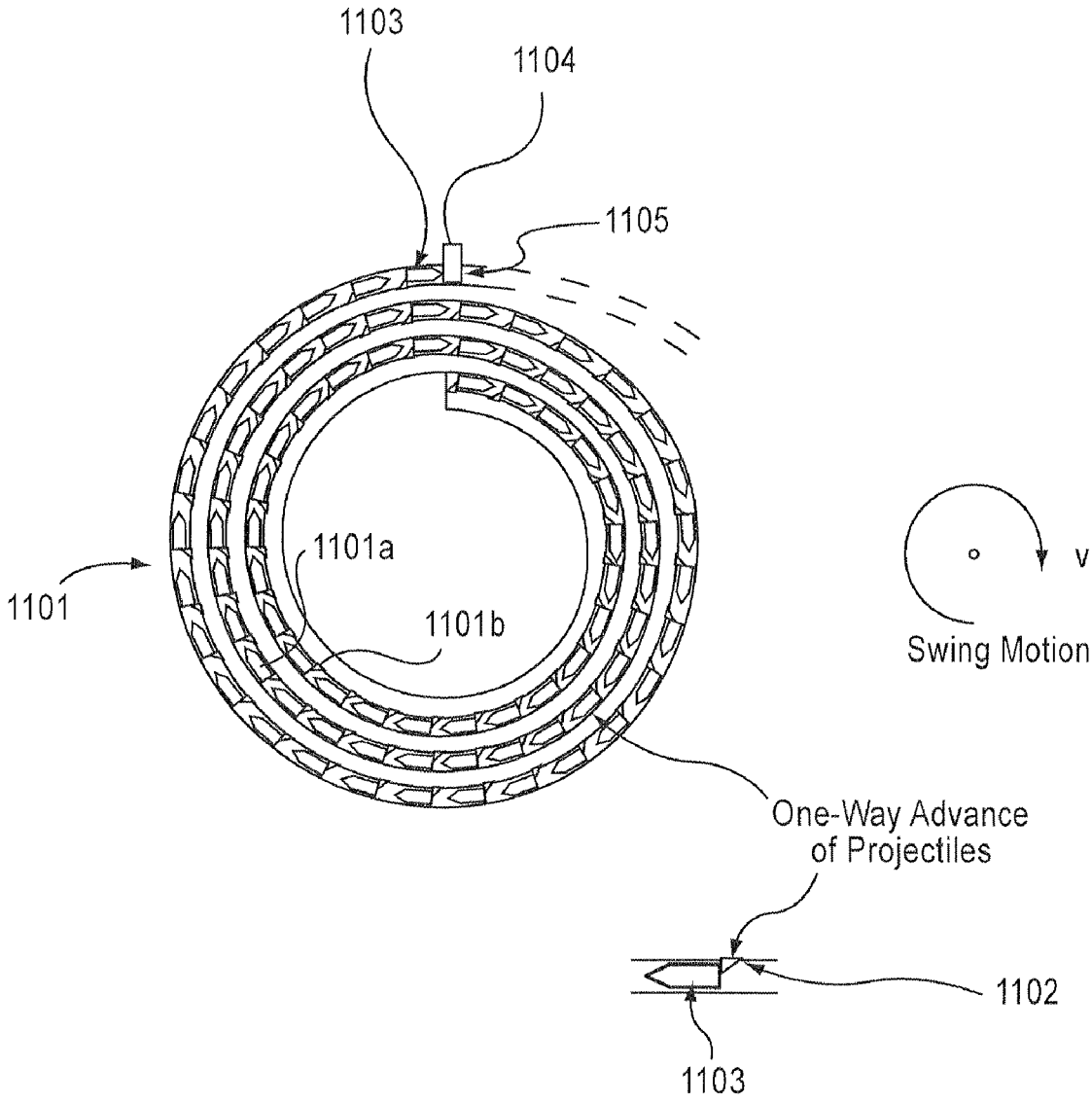
FIG. 11A shows a projectile storage and release component composed of inner rings that may be incorporated into various systems in accordance with aspects of the present invention.

FIG. 11A shows a projectile storage and release component 1101 composed of inner rings 1101*a* and 1101*b* that may be incorporated into various systems in accordance with aspects of the present invention. Although two inner rings 1101*a* and 1101*b* are shown in FIG. 11A, it is to be understood that there can be any suitable number of inner rings. The projectile storage and release component 1101 includes spaced inner rings 1101*a* and 1101*b* that could be added to the inner turns of a mass accelerator, such as the mechanical mass accelerator 300 in FIG. 10. These inner rings 1101*a* and 1101*b* may maximize their projectile storage capability by minimizing the gaps between the rings. These inner rings 1101*a* and 1101*b* gyrate with the track assembly of a mass accelerator in the swing motion shown in the inset of FIG. 11A.

A stopper 1102 prevents projectiles 1103 from advancing beyond a predetermined section 1102 of the storage and release component 1101. The stopper 1102 may include a simple one-way spring valve (not shown). One-way spring valves distributed along the projectile storage rings may be configured to permit stored projectiles 1103 to advance only in the clockwise direction in the above figure since the gyration sense is also clockwise as shown in FIG. 11. As a projectile is released for acceleration from the final stopper 1104 located at the projectile start portion 1105, each of the projectiles 1103 in the storage and release component 1101 is propelled forward by the gyration of the storage and release component 1101 and advances towards projectile start portion 1105. Note that the final stopper 1104 can include a stopping means that is retracted to the side of the projectile storage and release component 1101 when the projectile is released for final acceleration. The gyration caused by the operation of the mass accelerator causes the queue of projectiles 1103 to advance in the storage and release component 1101. This variation simplifies projectile storage and projectile injection into the mass accelerator. Furthermore, as the projectiles orbit with the same swing radius r as the acceleration turns, the projectiles are more efficiently injected into the system.

Figure 11B:
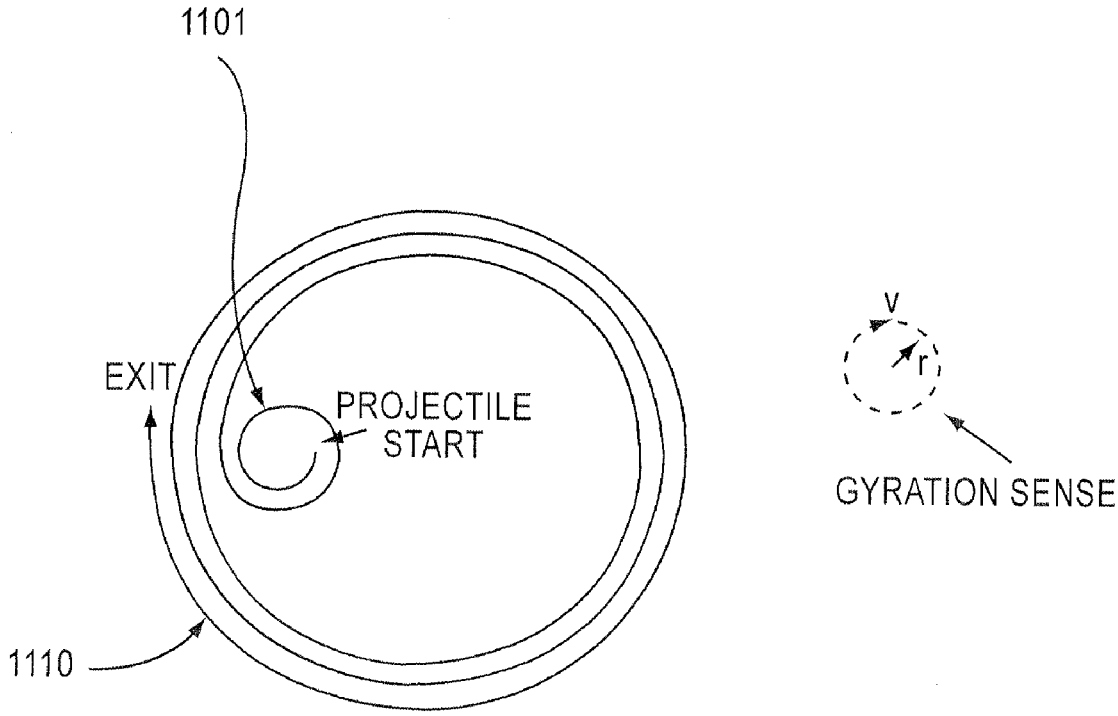
FIG. 11B illustrates that the projectile storage and release component 1101 may be included as an inner turn of a larger curved track 1110.

FIG. 11B illustrates that the projectile storage and release component 1101 may be included as an inner turn of a larger curved track 1110. The variation shown in FIG. 11B requires no initial injection energy for a projectile. In this variation, the projectile (not shown) may be anchored inside the track entrance of a first smaller curve before gyration of the track. After the track gyration has been brought up to speed, the anchored projectile may be released with zero speed relative to the track when the swing velocity is in the half cycle for which its centripetal acceleration has a forward component, so that the projectile is pressed against a breechblock (not shown). After its release, the projectile continues moving with the breechblock until the swing velocity becomes parallel to the track. The track then continues around its gyration circle, but pulls back so that the projectile moves forward relative to the breechblock and starts its acceleration around the first turn. This allows a projectile to be accelerated without any initial injection speed being provided by other means, such as a propellant charge.

The design of the mass or projectile is very important in providing mechanical mass accelerator systems with high efficiencies and high speed capabilities. For example, material selection is very important in some applications. Projectiles including layers of certain low thermal conductivity materials, such as polycarbonate, create a cushion of gas between the projectile and the steel tube as the projectile slides due to the evaporation of the low thermal conductivity materials. This gas cushion effectively performs in a manner similar to a mechanical bearing, often called a "gas bearing." The gas bearing is formed when the projectile's sliding "contact" material cannot, on the short timescale of the projectile's acceleration, dispose of its surface friction heat by thermally conducting it away into the interior of the projectile. Instead, this heat evaporates the material and creates the low friction gas bearing on which the projectile slides. For large projectiles the gas bearing becomes thicker than the asperity heights on the interior surface of the steel tube, so that damage to the mechanical mass accelerator tube appears to be avoided. Large projectiles generally have a smaller sliding friction coefficient than small projectiles. This occurs because the average "residence time" of gas evaporated from the friction-heated bearing surface of a large projectile is longer than for a geometrically similar small projectile. The "residence time" is the average time that gas molecules evaporated from the projectile's bearing surface remain trapped between the projectile and track surfaces, before being left in the projectile wake. The longer the residence time, the more effective the gas bearing (all other things being equal). The projectile's gas bearing is thus thicker for a large projectile, and its viscous drag per $cm^2$ on the track is smaller.

Figure 12:
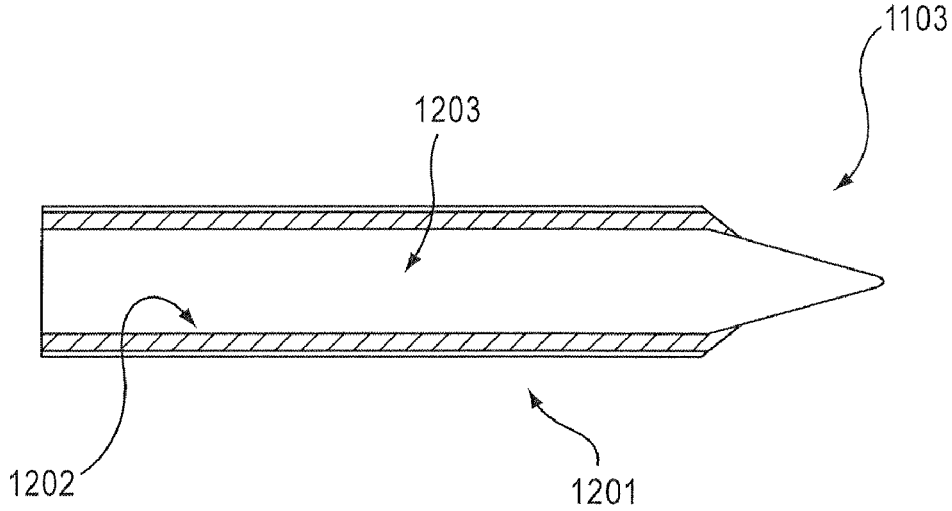
FIG. 12 shows aspects of an exemplary projectile that may be used in a mass accelerator.
Figure 12:
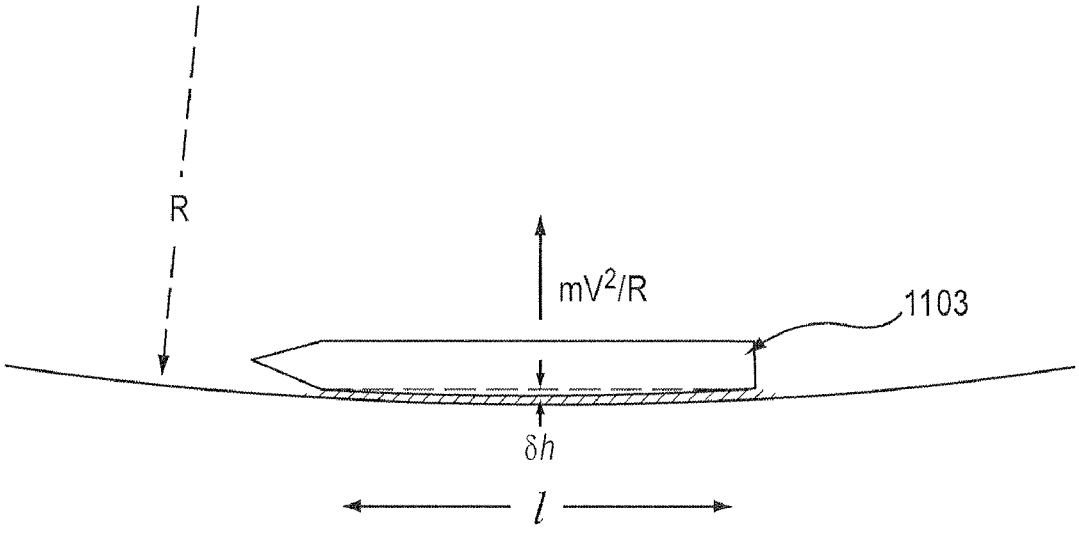

FIG. 12 shows aspects of an exemplary projectile that may be used in a mass accelerator. FIG. 12 shows the projectile 1103 having a central portion 1203, a layer of a low friction film 1201, and an additional layer 1202 located between the low-friction film 1201 and the central portion 1203. Among other low-friction materials, the low friction film 1201 may comprise Teflon or other synthetic, low friction materials. The additional layer 1202 may comprise a layer of low thermal conductivity material, for example a polymer such as polycarbonate or alternatively a propellant layer that aids the projectile in sliding on the track by combustion of an energetic material such as a propellant.

The film layer 1201 may be used to provide a small sliding friction coefficient for the projectile as it begins the acceleration process after being released from the projectile start portion 4 (FIG. 1). The accelerating centripetal force imparted by the track 2 then increases as the projectile gains velocity, and the compressibility of the additional layer 1202 then closes the very small "mid-point gap" δh shown in FIG. 12, which is the gap between the projectile's geometrical mid-point and the curved track. Thus, for a curved track and a projectile having a flat surface, there will be sliding contact against the later, larger turns in the track. As the projectile continues to accelerate to ~1 km/sec the low-friction film 1201 will wear off and the additional layer 1202 becomes exposed. Heat from the friction then evaporates a portion of the additional layer 1202, comprising a low thermal conductivity material such as polycarbonate or other suitable material. This generates a gas bearing and decreases the friction coefficient of the projectile, allows its velocity to increase and, therefore, causes a further decrease in the friction coefficient. Note also that the sliding friction coefficient for larger projectiles is generally smaller than for similarly constructed, smaller projectiles because the increased residence time of the evaporated gas in the gas bearing in the case of the larger particles creates a thicker gas bearing.

Figure 13:
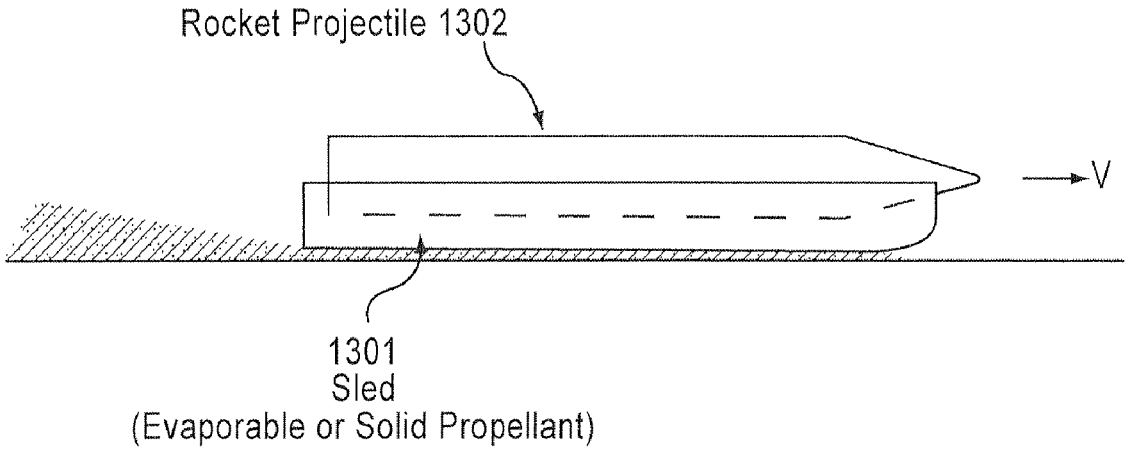
FIG. 13 shows a sled that is useful for accelerating large mass projectiles that may be composed of a variety of different materials and need no special coatings or outer layers.

FIG. 13 shows a sled 1301 that is useful for accelerating large mass projectiles that may be composed of a variety of different materials and need no special coatings or outer layers. The projectile 1302 is placed onto the sled 1301 and the sled contacts the track 2 of the mass accelerator. The sled contains elements similar to those for the optimized projectile described in connection with FIG. 12 so that the projectile 1302 does not require special outer layers. The projectile 1302 may be made of any suitable material.

The sled 1301 may include a low-friction layer of a material such as Teflon and a propellant layer, as described in connection with FIG. 12. After the sled's Teflon film has worn off (below ~1 km/sec), gas will be supplied to the bearing film by evaporation of the sled's sliding bearing material (e.g., polycarbonate) as shown in FIG. 12, or alternatively by combustion of an energetic sled material such as a propellant. Sled propellant could alternatively supply the bearing with gas at high velocity when the pressure of the gas bearing becomes large. FIG. 13 shows an example of a rocket projectile 1302, or a projectile with the shape of a rocket that can be used with a sled 1301. However, a rocket projectile 1302 is only one example of a mass or projectile that may be accelerated through the use of a sled 1301. Indeed, the sled 1301 is capable of accelerating projectiles of a number of shapes and sizes, including spherical or other round projectiles, rectangular projectiles bullet shaped projectiles and lozenge shaped projectiles. The mass may also be accelerated completely by the mass accelerator rather that incorporating additional acceleration means in the mass itself.

Figure 14:
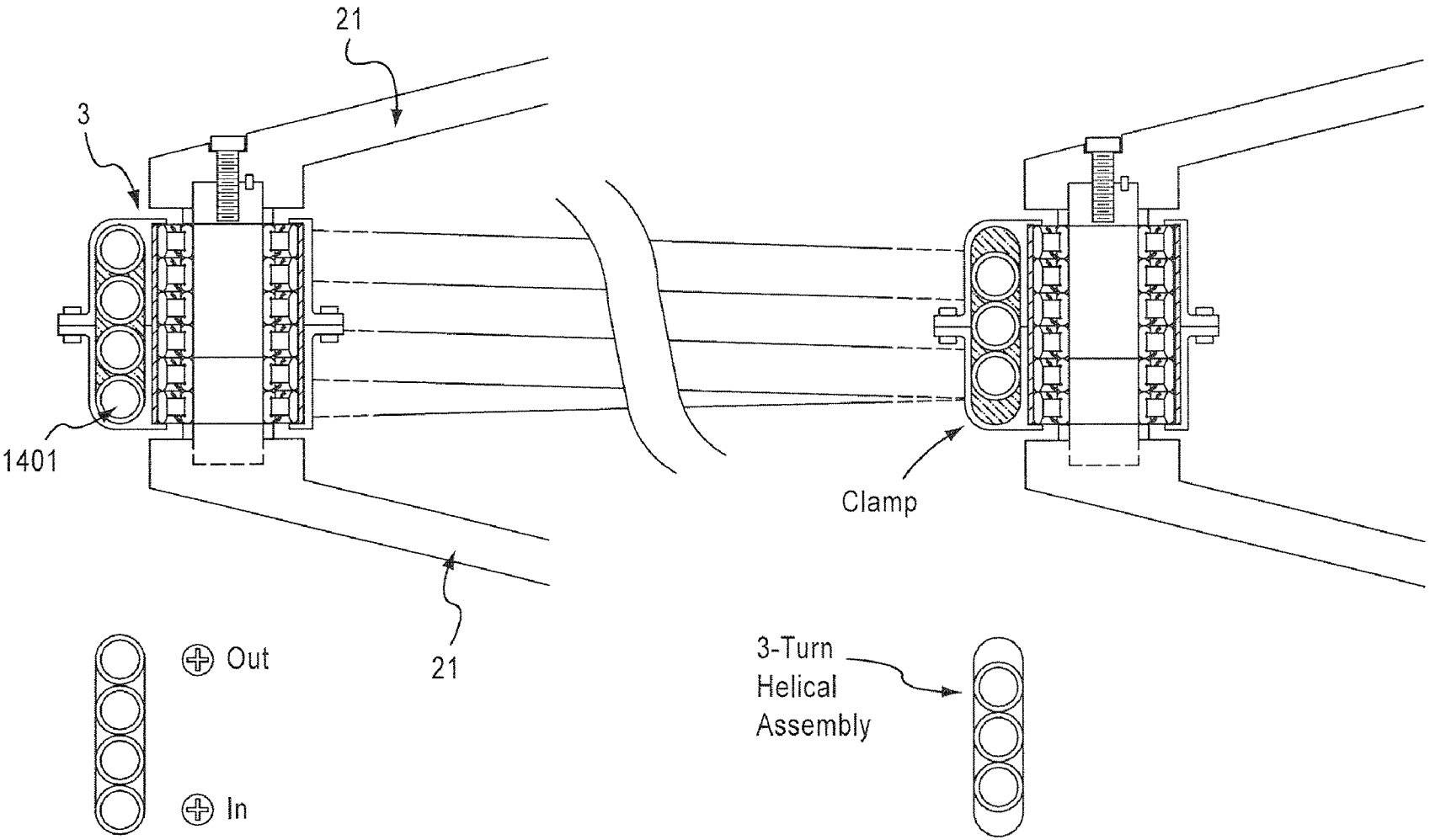
FIG. 14 illustrates an example of a clamping member for use with a track having closely packed helical turns.

FIG. 14 illustrates an example of a clamping member for use with a track having closely packed helical turns. The example shown in FIG. 14 shows an approximately three turn helical track, however, a track incorporating any number of turns may be used in connection with this variation. This could also be used as a 2-turn track assembly 1 with the first turn used for projectile storage as shown in FIGS. 1 and 11. The clamping portion 3 used in this variation may include any number of the low-friction features described in more detail in connection with FIGS. 4, 5, and 9, such as roller bearings, a low-friction layer, and a shock absorbing layer.

Figure 15:
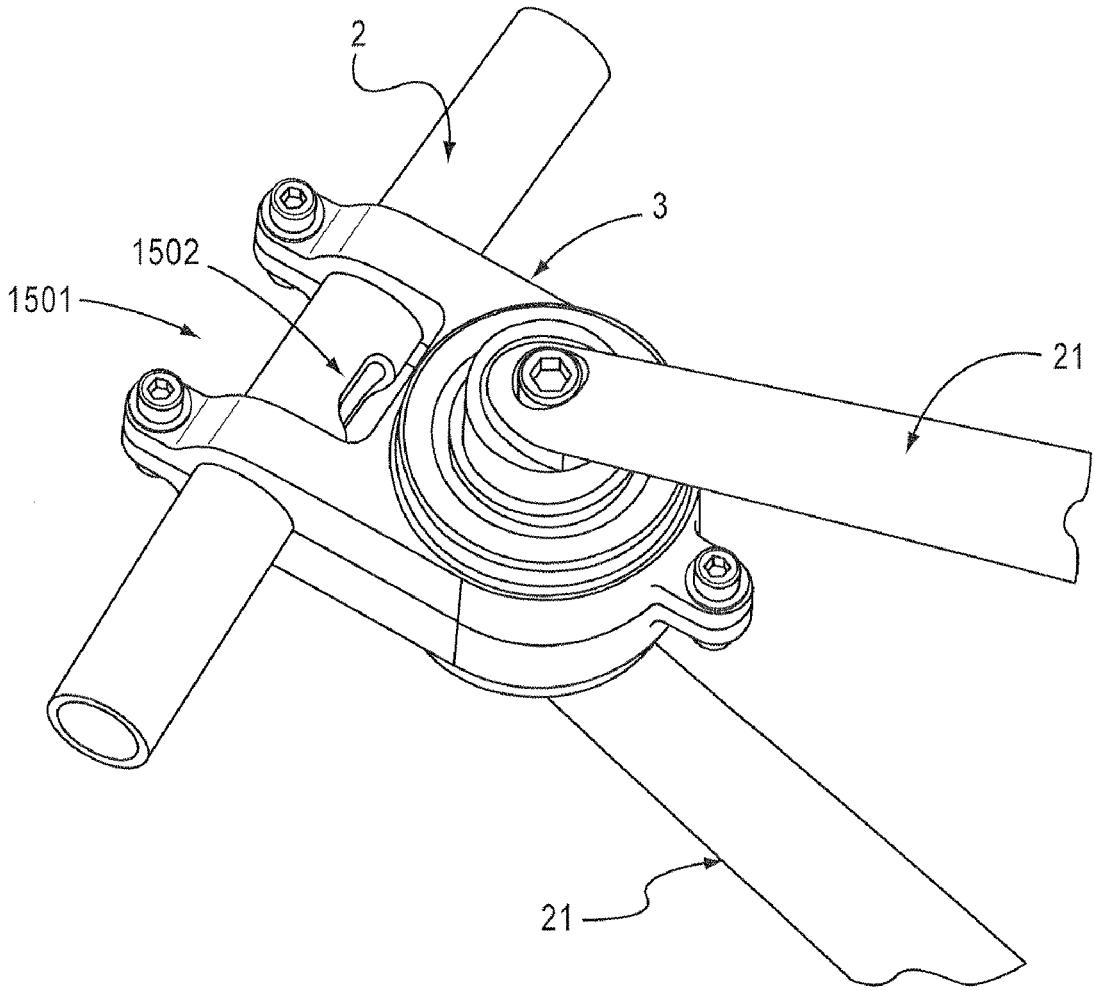
FIG. 15 illustrates an exemplary venting feature in the curved track.

FIG. 15 illustrates an exemplary venting feature 1501 in the curved track 2. Although this figure shows an example of a single tube clamped to clamping member 3 and bolted with two brackets, a venting feature 1501 may be provided in the dual track clamping member 3 described in connection with FIGS. 1 to 10 or with a track having any other geometry. The venting feature 1501 includes an opening 1502 in the track 2 located in the mid section of the clamping member 3, as shown, on the track 2 opposite the projectile bearing side of the tube. This opening 1502 provides ventilation of the gas deriving from the gas bearing created by the motion of the projectile. This gas generally trails behind a launched projectile. Venting it minimizes gas in the mechanical mass accelerator tube between projectile launches and, thereby, increases the efficiency of the mass accelerator. The opening 1502 is provided on the side of the track opposite the side against which the projectile slides when the track 2 is gyrated. This positioning of the 1502 prevents the projectile from coming into contact with it. Provision of opening 1502 at the position of the clamping member 3, such as between two arms of the clamps, provides for stability of the track 2.

Figure 16B:
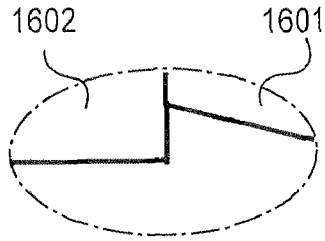
FIG. 16B is a close-up of the junction between two modular segments of FIG. 16A showing the tapering of the interior of one of the sections.
Figure 16A:
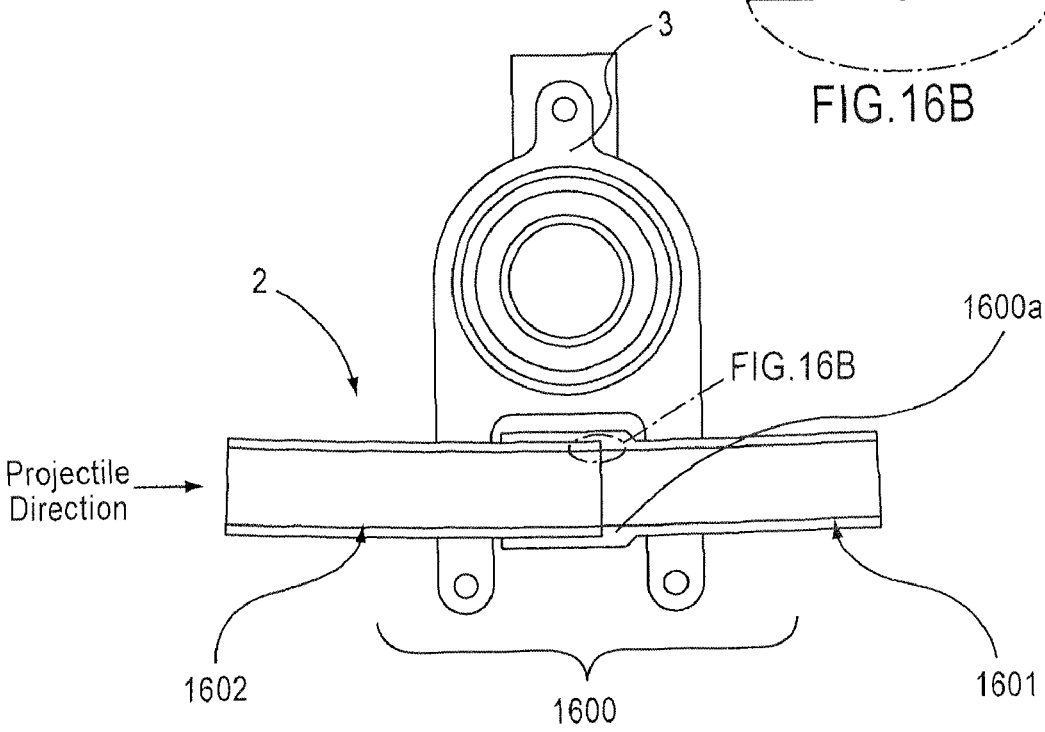
FIG. 16A shows a horizontal cross section view of two modular segments of a curved track joined together.

FIG. 16A shows a horizontal cross section view of two modular segments of a curved track joined together and FIG. 16B is a close-up of the junction between two modular segments of FIG. 16A showing the tapering of the interior of one of the sections. As the curved track in a mass accelerator may be very long in some cases, it may be helpful to use segments of track that are modular and may be connected to each other to form the larger track. Although FIG. 16 shows a single track 2 clamped to the clamping member 3, the modular track 1600 may be used in connection with other types of clamps or clamping members. In some applications, tube connections will likely be needed in only a small fraction of the clamps. A slight taper mouth 1600*a* may also be machined into the bore of the tube segment 1601 that receives the projectile to ensure that the projectile passes smoothly across the tube connection and into the receiving tube. Note that the direction of the projectile is labeled in FIG. 16A. As shown in FIG. 16B, it may be advantageous to taper the interior of the tube segment 1601 that receives the projectile at the joint also in order to allow smooth passage of the projectile. Tapering in the manner shown in FIG. 16B in another means of allowing smooth passage of the projectile between adjacent tube segments and to minimize wear on both the tube and projectile.

Figure 17:
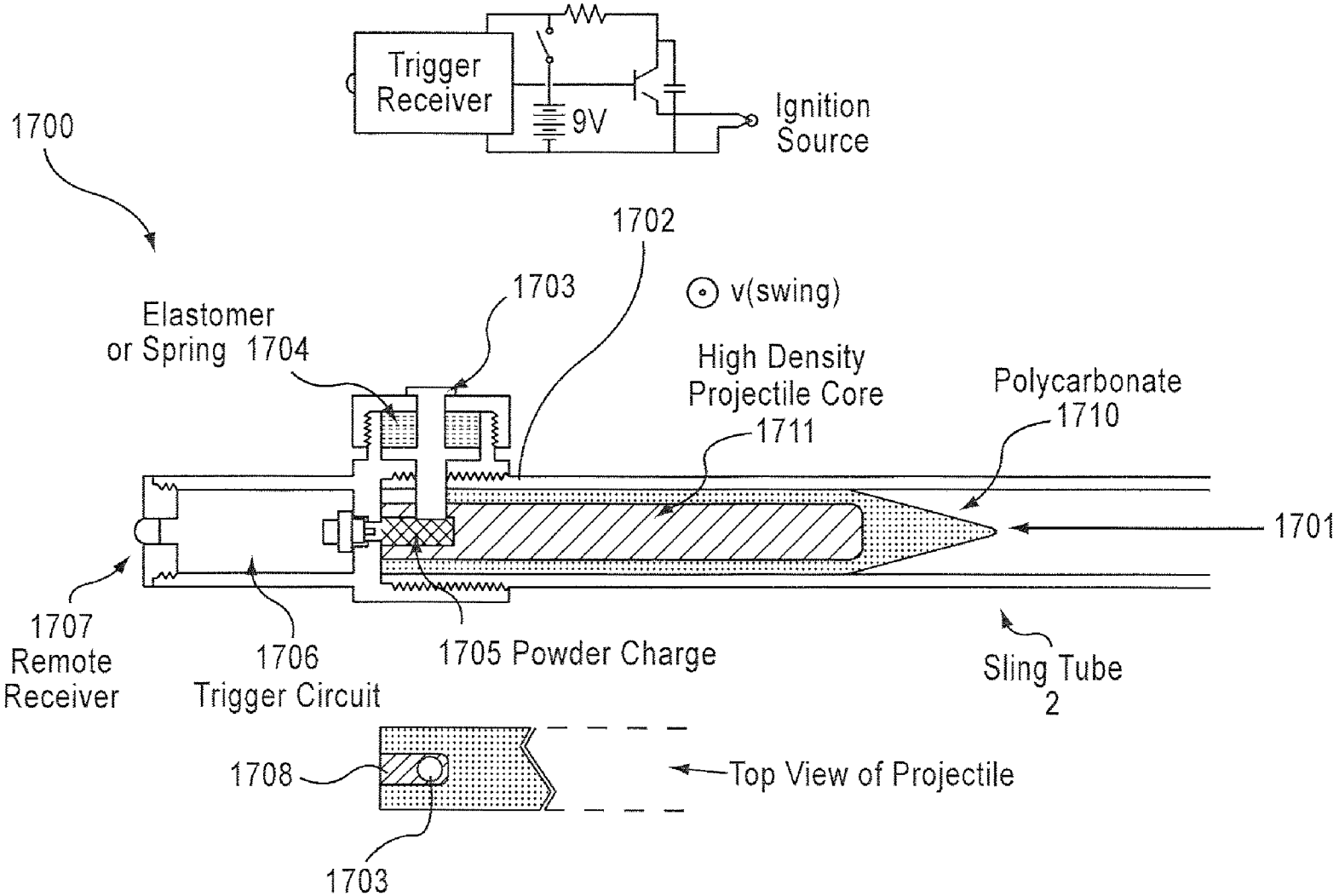
FIG. 17 illustrates aspects of an exemplary projectile release device that may be incorporated into a mass accelerator.

FIG. 17 illustrates aspects of an exemplary projectile release device that may be incorporated into a mass accelerator. The projectile release device may be located proximate to the curved track 2 of the mass accelerator and may be connected to a first segment of the curved track, as shown in FIG. 17. The projectile release device 1700 includes a housing section 1702 configured to receive a projectile 1701. The projectile may include features as described in more detail in connection with FIG. 12. The projectile includes a high density core 1711 and a polycarbonate layer 1710 surrounding the core 1711. A section 1708 of the polycarbonate layer and high density core 1711 is cut-away to receive a retention piece 1703, such as a piston. This cut-away portion 1708 enables the retention piece 1703 to move away from the projectile without damaging the projectile such as by tearing away portions of the polycarbonate layer 1710. The projectile release device 1700 may also include a powder charge piece 1705 that is received in another cutaway portion of the projectile such that the retention piece 1703 abuts the powder charge piece 1705. Although element 1705 is described as a powder charge piece, another propellant or combustible material may be used for this element. The retention piece 1703 is biased against the powder charge piece 1705. A biasing mechanism such as a spring or elastomer material may be used in conjunction with the retention piece 1703 for biasing it in a certain position. The projectile release device includes a remote receiver 1707 configured to receive a remote signal, and a trigger circuit 1706 that is configured to trigger the powder charge piece 1705 upon receipt of the remote signal by the remote receiver 1707. Among other ignition mechanisms, the remote signal may comprise a laser signal that provides a spark to ignite the propellant in the powder charge piece. When the powder charge piece 1705 is triggered, it pushes the retention piece 1703 such that it compresses the biasing mechanism and disengages from contact with the projectile. Propulsion from the powder charge piece 1705 initiates movement of the projectile into the curved track 2 of the mass accelerator.

For example, in one variation, a remote laser-triggered projectile release and start-up system may be employed. The mechanical mass accelerator is first powered-up to its full gyration speed, after which a laser pulse can be used to ignite the small powder charge. Note that the remote laser receiver window 1707 could alternatively be located on the side of the mechanical mass accelerator tube instead of at its end as shown in FIG. 17. Once the laser has initiated combustion of the powder charge 1705, combustion generates a high pressure gas that pushes the projectile's retention piece 1703 upward so that it compresses the elastomer or spring that is part of the retention piece 1703, thereby releasing the projectile so that it accelerates forward along the sling tube. The gas pressure generated by the powder charge piece 1705 contributes a relatively small initial start-up velocity for the projectile, but a higher start-up velocity could also be provided by using a larger propellant charge in the projectile.

Figure 18:
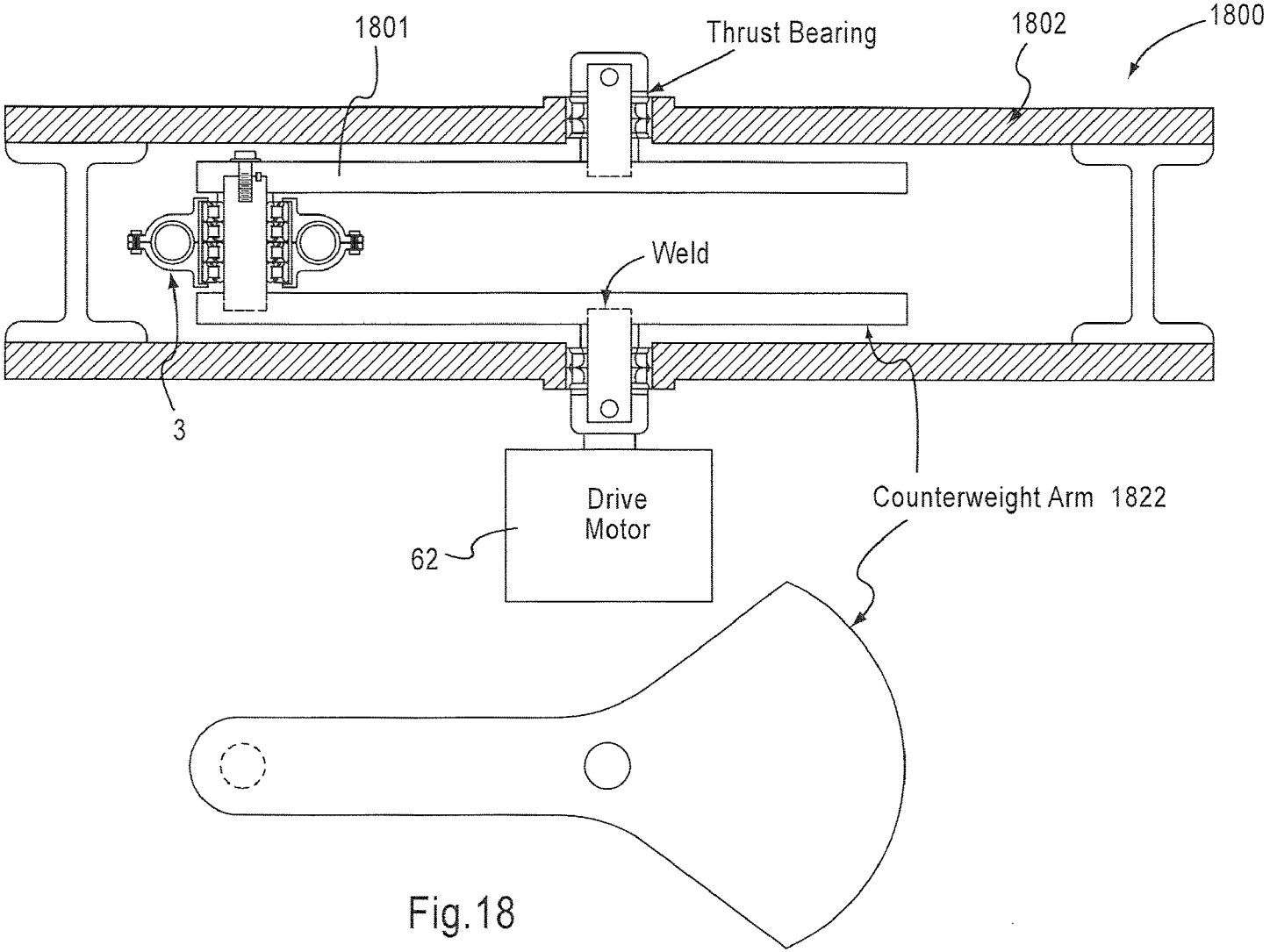
FIG. 18 shows a design with horizontal swing arm pairs for distribution along a mechanical mass accelerator track.

FIG. 18 shows a design 1800 with horizontal swing arm pairs for 1801 distribution along a mechanical mass accelerator track 2. The horizontal swing arm pairs 1801 are simpler to manufacture than the oblique arms 21 described in the preceding figures and might be attractive for some less demanding applications. The maximum gyration speed (and thus projectile speed) obtained using this simpler design is expected to be less than that available using the oblique swing-arm pairs 21 described in the preceding FIGS. 1 to 16. This is because fewer swing arm pairs 1801 can be incorporated into the device per unit length of track 2 because larger spacing between neighboring swing arm pairs 1801 is needed in order to avoid collisions between them. Large spacing between swing arm pairs 1801 also means that the loads on the bearings in the clamping members 3 will be larger because the track spans in between the clamping members 3 are correspondingly longer. Further, longer track spans between clamping portions 3 may give rise to excitation of elastic waves in the track 2.

The design 1800 is attractive in that it is simpler to build and involves fewer swing-arm pairs. The clamping member 3 used in connection with this horizontal swing arm 1801 may include any of the features described in connection with clamping members 3 used in the devices of FIGS. 4, 5, and 9. This design 1800 may further include additional bearings (not shown) and other friction or load reducing features between the swing arms 1801 and a housing 1802, such as those discussed in the context of FIGS. 4, 5 and 9.

Figure 19A:
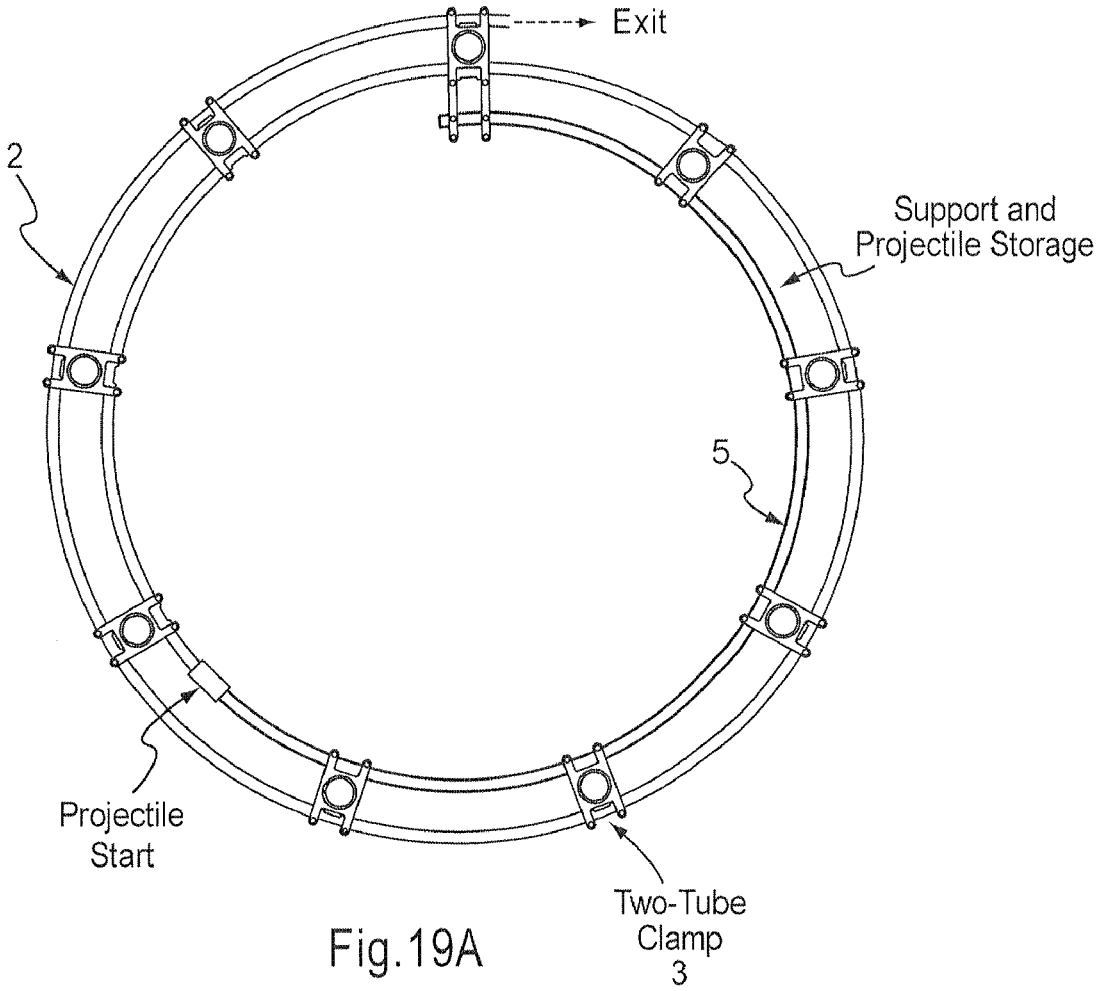
FIG. 19A illustrates an exemplary track assembly including a 2-turn spiral track 2 approximating and similar to the track assembly shown in FIG. 1A, but with relatively large gaps between clamping members 3 in order to accommodate the horizontal swing arm pairs shown in FIG. 18.
Figure 19B:
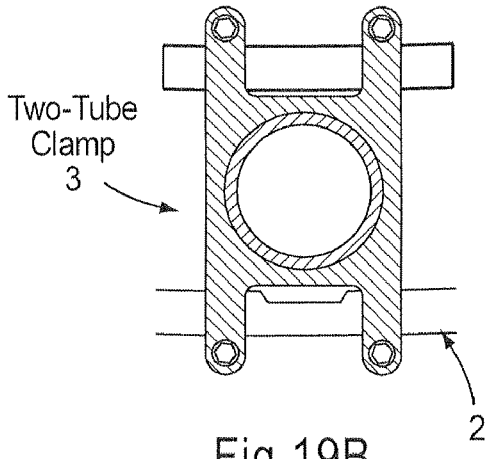
FIG. 19B is an inset, close-up top view of a section of the track assembly of FIG. 19A including a clamping member as well as two sections of the track.

FIG. 19A illustrates an exemplary track assembly including a 2-turn spiral track 2 approximating similar to the track assembly shown in FIG. 1A, but with relatively large gaps between clamping members 3 in order to accommodate the horizontal swing arm pairs shown in FIG. 18. FIG. 19B is an inset, close-up top view of a section of the track assembly of FIG. 19A including a clamping member as well as two sections of the track. These larger gaps allow horizontal arms 1801 as shown in FIG. 18 to be distributed around the ring 2 without collisions between neighboring arms and counterweights. The inner section 5 is not used for acceleration but provides a rigid tube structure that could be used for projectile storage as described in FIGS. 1 and 11. The projectile emerges from the track 2 when the track gyration velocity is parallel to the track for minimum angular dispersion.

Figure 20:
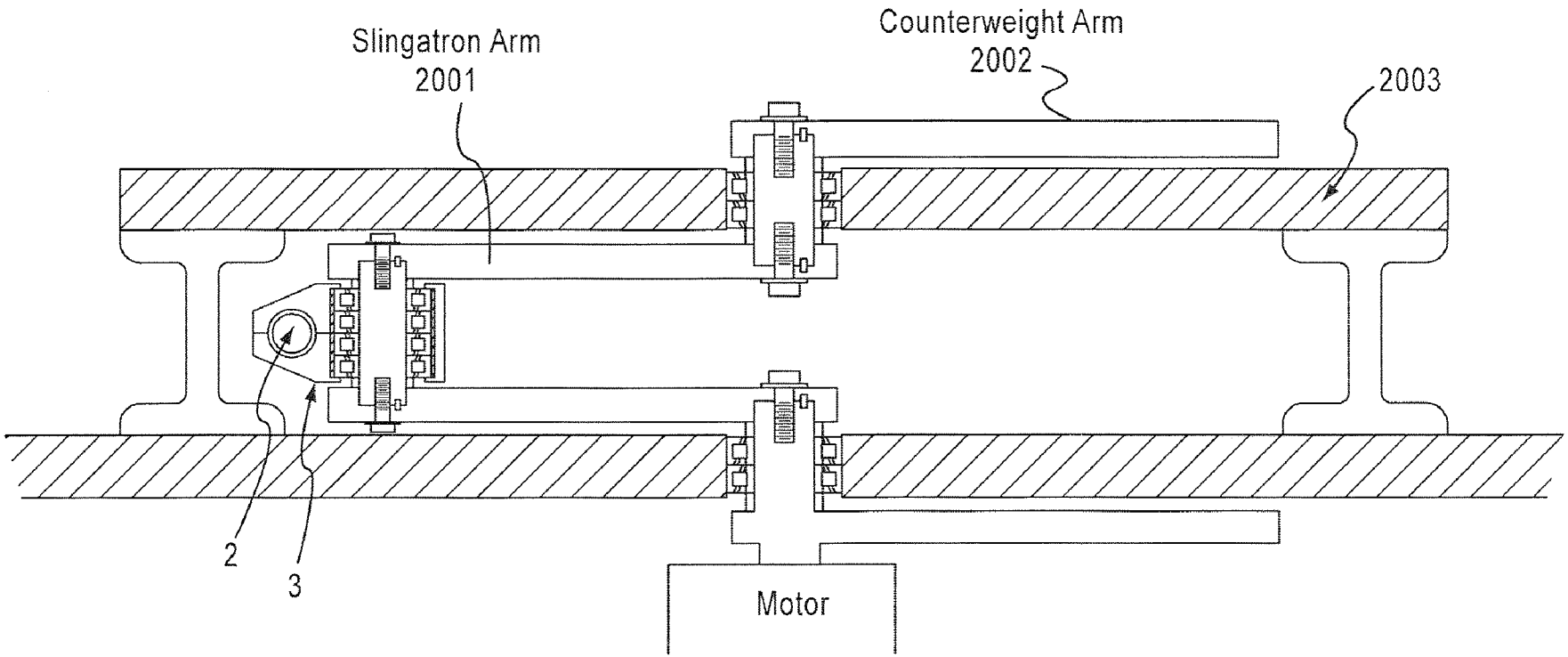
FIG. 20 illustrates another variation of the horizontal swing arm type mass accelerator, in which counterweights are used to balance the weight of the horizontal swing arms and the load at the end of the swing arms comprising the clamping member and the track.

FIG. 20 illustrates another variation of the horizontal swing arm type mass accelerator, in which counterweights 2002 are used to balance the weight of the horizontal swing arms 2001 and the load at the end of the swing arms 2001 comprising the clamping member 3 and the track 2. This design allows closer packing of the swing arms 2001 along the curved track 2 than that shown in FIG. 19. This is especially true if the counterweights are provided exterior to the housing 2003, as shown in FIG. 20. However, the counterweights may also be provided in alternative configurations. The clamping member 3 may include any of the features described in connection with previous clamping members 3.

Figure 21:
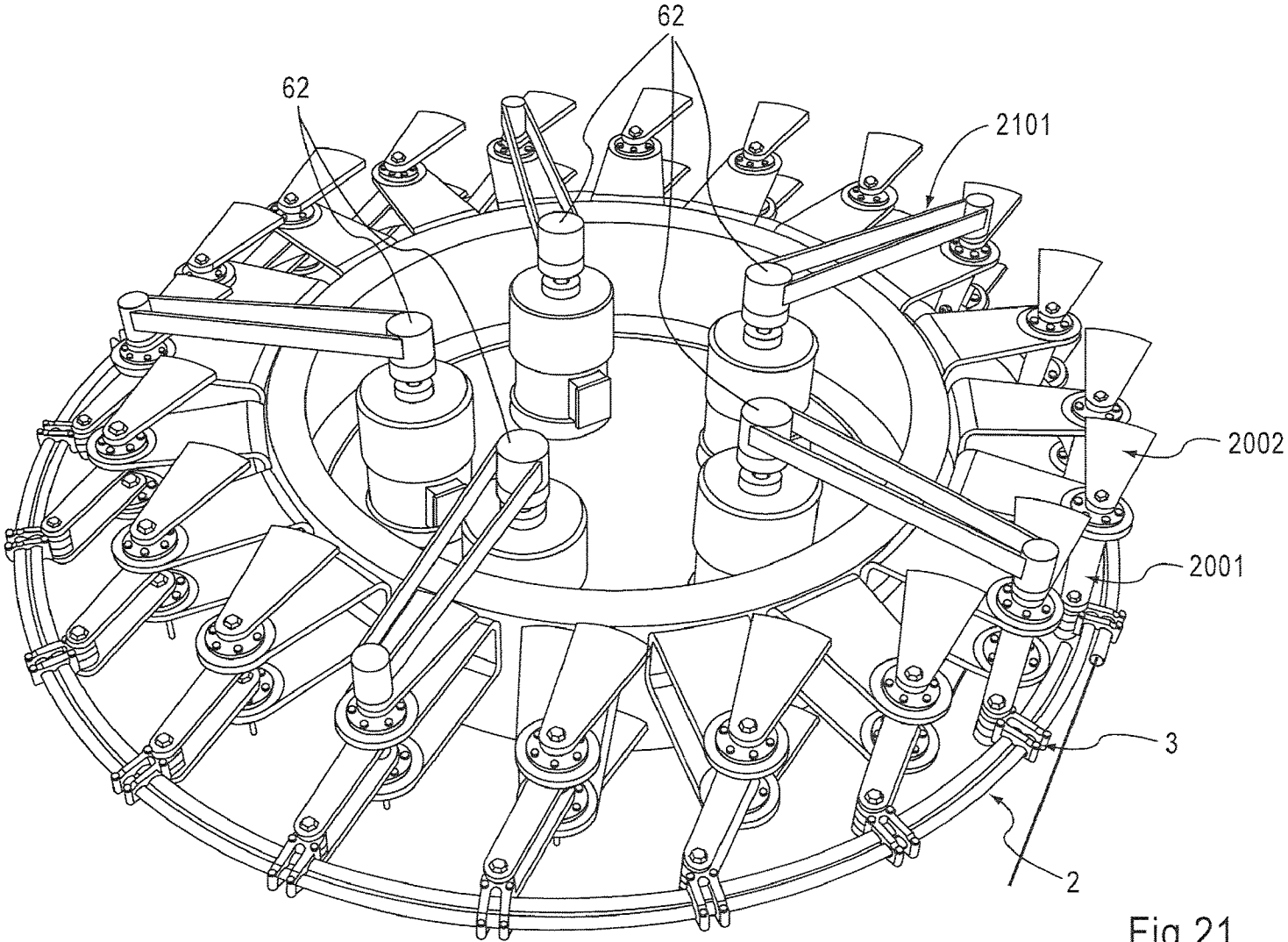
FIG. 21 illustrates an exemplary two-turn ring with displaced swing arms, similar to those shown in FIG. 20, along with additional support structure.

FIG. 21 illustrates an exemplary two-turn ring with displaced swing arms 2002, similar to those shown in FIG. 20, along with additional support structure. FIG. 21 also illustrates a belt component 2101 attached between the motors 62 and the swing arms 2002.

The mechanics of a mass accelerator or mechanical mass accelerators appear to scale well. That is to say that the same mass accelerator designs that work on relatively small size scales generally work well in these applications on larger size scales. In fact, scaled-up, larger versions of working designs in smaller machines often operate with the same gyration swing speed and projectile speed. The scalability of these designs is not limited to tracks and projectiles. It includes most other components, as well as the rated loads and lifetimes of the bearings, structure stresses, the drive system, impulse stresses on the tube due to the projectile, and track heating by projectile traversal. From this and other considerations, it can be deduced that huge mass accelerators could be built to launch projectiles of extremely large mass to very high velocity.

Figure 22:
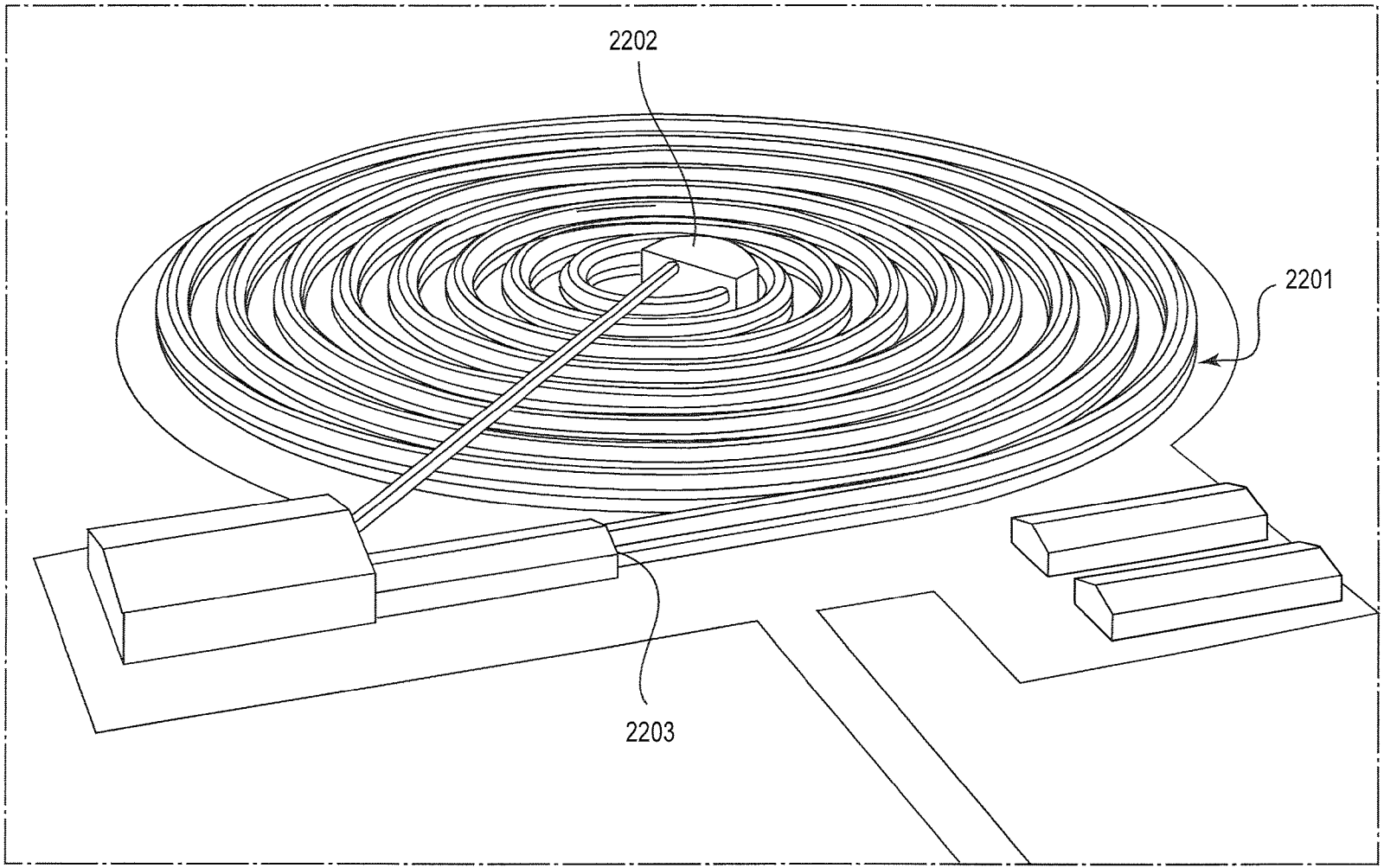
FIG. 22 shows an exemplary exterior housing layout for a conceptual large spiral mechanical mass accelerator with eight spiral turns capable of launching large projectiles to extreme velocity for physics impact experiments.
Figure 23:
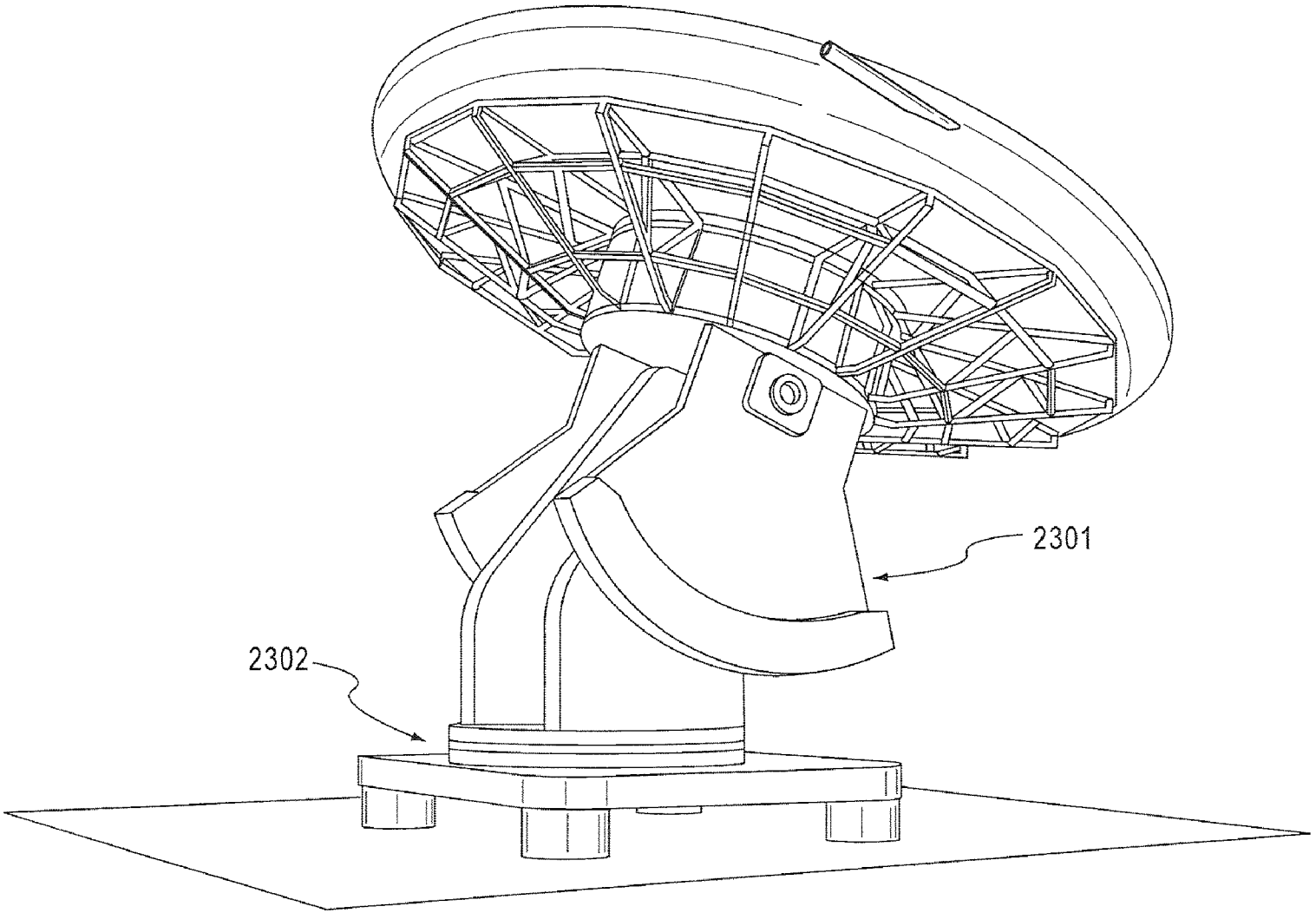
FIG. 23 illustrates another variation of an exemplary exterior housing for a large spiral mechanical mass accelerator that would enable the machine to launch large projectiles to high velocity in various directions and elevations.

FIGS. 22 and 23 illustrate exterior housings and additional components that may be used in connection with large mass accelerators.

FIG. 22 shows an exemplary exterior housing layout for a conceptual large spiral mechanical mass accelerator with eight spiral turns capable of launching large projectiles to extreme velocity for physics impact experiments. The spiral track in this case is not shown but the swing-arm pairs, which may be similar to any of the swing-arm pairs described herein, are distributed along a spiral track inside the spiral housing 2201. Further, the flywheel motor 81 of FIG. 8 can also be included within the spiral housing 2201. This variation may further include a control system to maintain the synchronized gyration phase and speed of the distributed swing arm pairs. The engaging mechanism may perform this control function, such as through the use of EM clutches similar to the modules described in connection with FIG. 8.

In order to operate the mass accelerator inside the spiral housing 2201 projectiles (not shown) may be released from a gyrating breech block (not shown) inside the release structure 2202. Subsequently, the projectiles would move forward through to the entrance end of the spiral tube at the correct phase time. The projectile then starts its acceleration out along the spiral, and after a few turns the projectile then becomes phase-locked with the (mixed transverse and longitudinal) wave that travels along the spiral path inside the spiral housing 2201 with speed $V \sim Rv/r$ (where: R is the local radius of curvature of the spiral path, r is the swing radius of the swing arm pairs (not shown), and v is the gyration velocity of the spiral tube). Thus, projectiles of very large size may be accelerated up to a velocity of many km/sec in such a spiral tube and could have a small sliding friction coefficient and mass loss due to the projectile's gas bearing between the track and the projectile bearing discussed in the context of FIG. 12, but just as applicable to projectiles on the scale of the spiral housing 2201. FIG. 22 also shows a building structure 2203 into which the high velocity projectile would exit the spiral for physics experiments or other applications. Such experiments may include, but are not limited to, impact fusion experiments, various other impact experiments and projectile or impact receptacle design testing.

FIG. 23 illustrates another variation of an exemplary exterior housing for a large spiral mechanical mass accelerator that would enable the machine to launch large projectiles to high velocity in various directions and elevations. Similar general design approaches may be used as described in connection with FIG. 23, i.e., it may have a control system that uses an engaging mechanism such as the EM clutches in the modules described in connection with FIG. 8, in order to maintain synchronized phase-locked gyration of the entire spiral sling tube. This variation may further include a rotation mechanism 2302 and a tilting mechanism 2301 to rotate and tilt the entire mass accelerator. This variation on mass accelerator housing may enable smart ballistic projectiles to be launched as needed in various directions and elevations for the rapid global delivery of commercial and humanitarian supplies. The mass accelerator could accelerate and launch the projectile and the projectile may further include direction features that direct the projectile to a predetermined location.

Potential applications of the mechanical mass accelerator include industrial processes such as impact powder production or hole boring tools; the rapid global transport of humanitarian and commercial supplies in smart ballistic containers; hypervelocity impact physics research including magnetized target fusion; hybrid launch systems consisting of the mechanical mass accelerator launch of projectiles or rocket projectiles for lower cost access to earth orbit or interplanetary space; and potential defense applications. These mass accelerators make use of the centripetal force to accelerate projectiles, and could be powered with either electric or combustion motors.

Although exemplary embodiments of the present invention have now been discussed in accordance with the above advantages, it will be appreciated by one of ordinary skill in the art that these examples are merely illustrative of the invention and that numerous variations and/or modifications may be made without departing from the spirit or scope invention.

Additional description regarding mass accelerators or mechanical mass accelerators may be found in "Sling Launch of a Mass Using Super-conducting Levitation", (submitted Oct. 30, 1994) D. A. Tidman, IEEE Trans. Magnetics, Vol. 32, No. 1, pages 240-247, January, 1996; "Sling Launch of Materials into Space", D. A. Tidman, R. L. Burton, D. S. Jenkins, and F. D. Witherspoon, in Proceedings of the 12th SSI/Princeton Conference on Space Manufacturing, May 4-7, 1995, edited by B. Faughnan, pp. 59-70; "Slingatron Mass Launchers", D. A. Tidman, Journal of Propulsion and Power, Vol. 14, No. 4, pp. 537-544, July-August, 1998; "Slingatron Dynamics and Launch to LEO", D. A. Tidman, Proceedings of the 13th SSI/Princeton Conference on Space Manufacturing, May 8-11, 1997, edited by B. Faughnan, Space Studies Institute, Princeton, N.J., pp. 139-141; "Slingatron Engineering and Early Experiments", D. A. Tidman and J. R. Greig, Proceedings of the 14th SSI/Princeton Conference on Space Manufacturing, May 6-9, 1999, pages 306-312, edited by B. Faughnan, Space Studies Institute, Princeton, N.J. (Spiral); D. A. Tidman, "A Scientific Study on Sliding Friction Related to Slingatrons", UTRON Inc., Final Report for U.S. Army Contract No. DAAD17-00-P-0710, Feb. 20, 2001; M. Bundy, G. R. Cooper, S. Wilkerson, and E. Schmidt., "Optimizing a Slingatron-Based Space Launcher Using Matlab," Proceedings of the 10th U.S. Army Gun Dynamics Symposium, Apr. 23-26, 2001, Austin, Tex.; G. R. Cooper, D. A. Tidman, and M. Bundy, "Numerical Simulations of the Slingatron," Proceedings of the 10th U.S. Army Gun Dynamics Symposium, Apr. 23-26, 2001, Austin, Tex.; D. A. Tidman, "The Spiral Slingatron Mass Launcher," CP552, Space Technology and Applications International Forum-2001, edited by M. S. El-Genk, published by the American Institute of Physics, 2001. 1-56396-980-7/01; D. A. Tidman, "Slingatron: A High Velocity Rapid Fire Sling," published in the Proceedings of the 10th U.S. Army Gun Dynamics Symposium, Apr. 23-26, 2001, Austin, Tex.; G. R. Cooper, D. A. Tidman, and M. L. Bundy, "Numerical Simulations of the Slingatron," AIAA Journal of Propulsion and Power, Vol. 18, No. 2, March-April, 2002, p. 338-343; M. L. Bundy, D. A. Tidman, and G. R. Cooper, "Sizing a Slingatron-Based Space Launcher," AIAA Journal of Propulsion and Power, Vol. 18, No. 2, March-April, 2002, p 330-337; D. A. Tidman, "Slingatron: A High Velocity Rapid Fire Sling," AIAA Journal of Propulsion and Power, Vol. 18, No. 2, March-April 2002, p 322-329; G. R. Cooper and D. A. Tidman, "Study of the Phase-Lock Phenomenon for a Circular Slingatron," AIAA Journal of Propulsion and Power, Vol. 18, No. 3, May-June, 2002, p 505-508; Constant-Frequency Hypervelocity Slings, D. A. Tidman, AIAA J. Propulsion and Power, July-August, No. 4., 2003, pp 581-587, "Slingatron—A Mechanical Hypervelocity Mass Accelerator", D. A. Tidman, published by Aardvark Global Publishing LLC, 2007, the entire contents of each of which are herein incorporated by reference.

We claim:

1. An apparatus for moving a mass, the apparatus comprising:

an arcuate track having an outer section and inner section spaced apart from the outer section at a concentric location within the outer section;

a clamping member attaching two sections of the arcuate track, wherein the two sections include a section of the outer section and a section of the inner section of the arcuate track;

an arm assembly pivotably connected to the clamping member; and a counterweight connected to the arm assembly.

2. The apparatus according to claim 1, wherein the clamping member includes:

a first piece;

a second piece; and a fastener that fastens the first piece to the second piece, wherein the first piece and second piece are configured to surround a section of the arcuate track.

3. The apparatus according to claim 2, wherein the arm assembly includes:

a first arm; and a second arm, wherein a first counterweight is connected to the first arm and a second counterweight is connected to the second arm.

4. The apparatus according to claim 3, wherein the first arm and second arm are pivotably connected to the clamping member at an oblique angle to each other.

5. The apparatus according to claim 3, wherein the first arm and the second arm are parallel to each other, and wherein the first and second counterweight is displaced from the location of the first and second arm.

6. The apparatus according to claim 5, further comprising:

a housing configured to surround at least the arm assembly, arcuate track, and clamping member, wherein the first and second counterweight are provided exterior to the housing.

7. The apparatus according to claim 1, further comprising:

a housing configured to surround the arm assembly, arcuate track, and clamping member, and wherein the housing includes a pressure feature for one of lowering the air pressure within the housing and filling the housing with a selected gas.

8. The apparatus according to claim 1, further comprising:

a shaft at a first end of the arm assembly, wherein the clamping member has an opening configured to receive the shaft.

9. The apparatus according to claim 8, further comprising:

at least one selected from a group consisting of a bearing surrounding the shaft, a shock absorbing layer located between the shaft and the clamping member, and a low-friction layer located between the shaft and the clamping member.

10. The apparatus according to claim 8, the apparatus comprising:

a stack of bearings surrounding the shaft;

a shock absorbing layer between the clamping member and the stack of bearings; and a low-friction film between the shaft and the stack of bearings.

11. The apparatus according to claim 1, further comprising:

a mass storage and release device, the device including:

a tube configured to receive a plurality of masses, wherein the tube connects to the arcuate track; and a stopper configured to prevent the plurality of masses from passing into the arcuate track.

12. The apparatus according to claim 11, wherein the stopper is a one-way valve configured to allow one mass to enter the arcuate track at a time.

13. The apparatus according to claim 11, wherein the tube is a curved portion of the inner section of the arcuate track.

14. The apparatus according to claim 1, further comprising:

a motor driving the arm assembly; and a flywheel engageable with the motor.

15. The apparatus according to claim 14, further comprising:

an engaging mechanism for engaging and disengaging the flywheel with the motor.

16. The apparatus according to claim 15, wherein the engaging mechanism is an electromagnetic clutch.

17. The apparatus according to claim 1, wherein the arcuate track is shaped as one selected from a group consisting of a ring, a spiral, and a helix.

18. The apparatus according to claim 17, wherein the arcuate track comprises multiple turns.

19. The apparatus according to claim 18, wherein the arcuate track is a tube.

20. The apparatus according to claim 1, wherein the arcuate track comprises a plurality of segments of track connected to each other to form the arcuate track.

21. The apparatus according to claim 20, wherein a first segment of track inserts into a second segment of track, and wherein the second segment includes a taper on the interior of the track.

22. The apparatus according to claim 1, wherein the arcuate track is a tube, and wherein the tube includes a vent.

23. The apparatus according to claim 22, wherein the vent comprises an opening in a side of the tube opposite a side of the tube against which the mass contacts.

24. The apparatus according to claim 23, wherein the opening is proximate to the clamping member.

* * * * *